US009250550B2

(12) United States Patent
Sumioka

(10) Patent No.: US 9,250,550 B2
(45) Date of Patent: Feb. 2, 2016

(54) ELECTROSTATIC CHARGE IMAGE DEVELOPING TONER

(71) Applicant: KYOCERA DOCUMENT SOLUTIONS INC., Osaka (JP)

(72) Inventor: Syo Sumioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/084,402

(22) Filed: Nov. 19, 2013

(65) Prior Publication Data

US 2014/0134532 A1 May 15, 2014

(51) Int. Cl.
*G03G 9/093* (2006.01)

(52) U.S. Cl.
CPC ..... *G03G 9/09371* (2013.01); *G03G 9/09314* (2013.01); *G03G 9/09321* (2013.01); *G03G 9/09357* (2013.01); *G03G 9/09392* (2013.01)

(58) Field of Classification Search
CPC ..... G03G 9/09321; G03G 9/09328; G03G 9/09371
USPC ..... 430/110.2
See application file for complete search history.

(56) References Cited

U.S. PATENT DOCUMENTS

| | | | | |
|---|---|---|---|---|
| 2006/0210899 | A1* | 9/2006 | Nakazawa et al. | 430/106.1 |
| 2006/0210904 | A1* | 9/2006 | Ninomiya et al. | 430/110.2 |
| 2008/0096120 | A1* | 4/2008 | Yamaguchi et al. | 430/110.2 |
| 2013/0130171 | A1* | 5/2013 | Watanabe et al. | 430/110.2 |

FOREIGN PATENT DOCUMENTS

| | | | | | |
|---|---|---|---|---|---|
| JP | S62-090686 | A | | 4/1987 | |
| JP | 02302760 | A | * | 12/1990 | G03G 9/08 |
| JP | 2005-099081 | A | | 4/2005 | |
| JP | 2006064960 | A | * | 3/2006 | |
| JP | 2006243107 | A | * | 9/2006 | |
| JP | 2008064837 | A | * | 3/2008 | |
| JP | 2009163026 | A | * | 7/2009 | |
| JP | 2010-026386 | A | | 2/2010 | |
| JP | 2010-090355 | A | | 4/2010 | |

OTHER PUBLICATIONS

English language machine translation of JP 2006-064960 (Mar. 2006).*
English language machine translation of JP 2008-064837 (Mar. 2008).*
English language machine translation of JP 2009-163026 (Jul. 2009).*
English language machine translation of JP 2006-243107 (Sep. 2006).*
English language translation of JP 02-302760 (Dec. 1990).*

* cited by examiner

*Primary Examiner* — Christopher Rodee
(74) *Attorney, Agent, or Firm* — Studebaker & Brackett PC

(57) ABSTRACT

An electrostatic charge image developing toner includes a toner core including at least a binder resin and a shell layer configured to cover the toner core. The shell layer includes an inner layer and an outer layer. A difference obtained by subtracting a SP value of a material for the inner layer from a SP value of the binder resin, $\Delta SP_1$, is 0.3 or larger and 1.4 or lower. A difference obtained by subtracting a SP value of a material for the outer layer from the SP value of the material for the inner layer, $\Delta SP_2$, is 0.5 or larger and 1.6 or lower. The $\Delta SP_1$ is below the $\Delta SP_2$.

7 Claims, No Drawings

ELECTROSTATIC CHARGE IMAGE DEVELOPING TONER

INCORPORATION BY REFERENCE

The present application claims priority under 35 U.S.C. §119 to Japanese Patent Application No. 2012-255706, filed Nov. 21, 2012. The contents of this application are incorporated herein by reference in their entirety.

BACKGROUND

The present disclosure relates to electrostatic charge image developing toners.

In order to save on energy consumption or to achieve size reduction in image forming apparatuses using toner, it is desirable that the toner has excellent fixability at low temperature. The use of such toner can achieve suitable fixability, while suppressing heating of a fixing roller. However, the toner excellent in fixability at low temperature includes at least one of a binder resin having a low melting point or glass transition point and a releasing agent having a low melting point in many cases. Such the toner tends to aggregate in high temperature storage. Aggregation of the toner may tend to cause image defect or fogging in image formation. The image defect might be caused due to adhesion of the toner to a development sleeve or a photosensitive drum. The fogging might be caused due to charge failure of the toner.

In view of the foregoing, in order to improve the fixability of the toner in a wide range of temperature, to enhance the preservation stability of the toner at high temperature, or to improve the blocking resistance of the toner, a toner having a core-shell structure has been proposed. Core particles of such the toner are each covered with a shell layer. In some toner having a core-shell structure, the core particles include a binder resin with a low melting point, and the glass transition point (Tg) of a resin forming the shell layer is higher than the glass transition point (Tg) of the binder reins of the core particles. Further, an intermediate layer and the shell layer are formed on the surface of each core particle. The intermediate layer includes wax. The shell layer includes crystalline polyester resin with a softening point of 60° C. or higher and 120° C. or lower at a rate of 70% by mass or higher and 100% by mass or lower.

SUMMARY

The present disclosure provides the following.

An electrostatic charge image developing toner according to the present disclosure includes a toner core including at least a binder resin and a shell layer configured to cover the toner core. The shell layer includes an inner layer containing a first resin and an outer layer containing a second resin. A difference obtained by subtracting a SP value ($SP_t$) of the first resin of the inner layer from a SP value ($SP_c$) of the binder resin, $\Delta SP_1$ ($=SP_c-SP_t$), is +0.3 or larger and +1.4 or smaller. A difference obtained by subtracting a SP value ($SP_s$) of the second resin outer layer from the SP value ($SP_t$) of of the first resin of the inner layer, $\Delta SP_2$ ($=SP_t-SP_s$), is +0.5 or larger and +1.6 or smaller. The $\Delta SP_1$ is below the $\Delta SP_2$.

DETAILED DESCRIPTION

Embodiments of the present disclosure will be described in detail below. The present disclosure is not limited to the following embodiments and can be reduced in practice with appropriate alteration within the scope of the purpose of the present disclosure. It is noted that description of duplicate parts may be omitted appropriately, which however, should not be taken to limit the present disclosure.

An electrostatic charge image developing toner (hereinafter referred also to merely as a toner) according to the present disclosure includes a toner core including at least a binder resin and a shell layer that covers the toner core. The shell layer includes an inner layer and an outer layer. In the present embodiment, solubility parameters (hereinafter referred also to as merely SP values) of the binder resin, the inner layer, and the outer layer are adjusted to fall within respective predetermined ranges. The electrostatic charge image developing toner according to the present embodiment will be described below.

<<SP Value>>

Each SP value in the present embodiment is a value expressed by a square root of molecular cohesive energy. The SP value can be calculated by the method described in R. F. Fedors, Polymer Engineering Science, 14, Page 147 (1974). The unit of the SP value is $(MPa)^{1/2}$. Each SP value in the present embodiment is the value at 25° C.

Hereinafter, the SP value of the binder resin is represented by $SP_c$. The SP value of a material for the inner layer of the shell layer is represented by $SP_t$. The SP value of a material for the outer layer of the shell layer is represented by $SP_s$. The difference obtained by subtracting $SP_t$ from $SP_c$ is represented by $\Delta SP_1$ ($=SP_c-SP_t$). The difference obtained by subtracting $SP_s$ from $SP_t$ is represented by $\Delta SP_2$ ($=SP_t-SP_s$). In preparation of the toner according to the present disclosure, $SP_c$, $SP_t$, and $SP_s$ respectively for the binder resin, the material for the inner layer of the shell layer, and the material for the outer layer of the shell layer satisfy the following relationships.

$$0.3 \le \Delta SP_1 \le 1.4 (0.3 \le SP_c - SP_t \le 1.4)$$

$$0.5 \le \Delta SP_2 \le 1.6 (0.5 \le SP_t - SP_s \le 1.6)$$

$$\Delta SP_1 < \Delta SP_2 (SP_c - SP_t < SP_t - SP_s)$$

The toner in which $SP_c$, $SP_t$, and $SP_s$ satisfy the above relationships can be favorably fixed to a recording medium in a wide temperature range and can be excellent in heat resistant preservability and mechanical strength.

Where $\Delta SP_1$ is too small, the toner core and the inner layer of the shell layer may tend to be compatible. Accordingly, a component, such as a releasing agent, may transfer from the toner core to the inner layer of the shell layer, which tends to cause exposure of the component at an interface between the inner layer and the outer layer of the shell layer. When the component of the toner core is exposed at the interface between the inner layer and the outer layer, the inner layer and the outer layer of the shell layer may tend to peel off, and the shell layer may tend to reduce in strength. Reduction in strength of the shell layer may tend to impair the heat resistant preservability or the mechanical strength of the toner.

Where $\Delta SP_1$ is too large, the toner core and the inner layer of the shell layer tend to be incompatible. Accordingly, mechanical stress may be caused, thereby resulting in that the shell layer may tend to peel off from the toner core. Peeling off of the shell layer may impair the mechanical strength of the toner. Further, where $\Delta SP_1$ is too large, it may be hard to favorably fix the toner to a recording medium at low temperature.

Where $\Delta SP_2$ is too small, the inner layer and the outer layer of the shell layer tend to be compatible to firmly bonded together. Accordingly, the strength of the shell layer may become excessive. Where the strength of the shell layer is excessive, the shell layer may be hard to collapse in fixing the toner to paper. Accordingly, too small $\Delta SP_2$ may tend to impair the fixability of the toner at low temperature.

Where $\Delta SP_2$ is too large, the inner layer and the outer layer of the shell layer tend to be incompatible. Accordingly, the inner layer and the outer layer of the shell layer may be hard to be favorably bonded together. Bonding failure between the inner layer and the outer layer of the shell layer may cause reduction in strength of the shell layer in some cases. Accordingly, too large $\Delta SP_2$ may tend to impair the heat resistant preservability and the mechanical strength of the toner.

<<Electrostatic Charge Image Developing Toner>>

The toner according to the present disclosure includes the toner core and the shell layer that covers the toner core. An external additive may be attached to the surface of the shell layer, as necessary. The toner of the present disclosure may be mixed with a desired carrier to be used as a two-component developer. Description will be made below about the toner core and the shell layer, which form the toner of the present disclosure, the external additive as an optional component, a carrier used where the toner of the present disclosure is used as a two-component developer, and a method for producing the toner of the present disclosure in this order.

[Toner Core]

The toner core forming the toner of the present disclosure includes at least the binder resin. In addition to the biding resin, the toner core may include a component, such as colorant, a releasing agent, and a charge control agent, as desired. Essential or optional components (binder resin, colorant, releasing agent, and charge control agent) of the toner core will be described below in sequence.

[Binder Resin]

The binder resin included in the toner core of the toner according to the present disclosure is not particularly limited as long as $SP_c$, $SP_t$, and $SP_s$ satisfy the aforementioned predetermined relationships.

Specific examples of the binder resin include thermoplastic resins, such as styrene-based resin, acrylic resin, styrene-acrylic resin, polyethylene-based resin, polypropylene-based resin, vinyl chloride-based resin, polyester resin, polyamide resin, polyurethane resin, polyvinyl alcohol-based resin, vinyl ether-based resin, N-vinyl-based resin, and styrene-butadiene-based resin. In order to enhance the dispersibility of the colorant in the toner, the charging characteristics of the toner, and the fixability of the toner to paper, styrene-acrylic resin and polyester resin are preferable. Yet, polyester resin is more preferable. The styrene-acrylic resin and the polyester resin used in the present embodiment will be described below.

The styrene-acrylic resin is a copolymer of styrene-based monomers and acrylic monomers. Specific examples of the styrene-based monomers include styrene, α-methylstyrene, vinyltoluene, α-chlorostyrene, o-chlorostyrene, m-chlorostyrene. p-chlorostyrene, and p-ethylstyrene. Specific examples of the acrylic monomers include alkyl (meth)acrylate esters, such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Where the styrene-acrylic resin is used as the binder resin, increase/decrease in amount of use of (meth)acrylic acid in preparing (meth)acrylic resin can adjust $SP_c$.

Where the polyester resin is used as the binder resin, toner that can be favorably fixed in a wide temperature range or toner excellent in chromogenic property can be prepared easily. For example, polyester resin can be used which can be obtained by condensation polymerization or co-condensation polymerization of a divalent or trivalent or more-valent alcohol component and a divalent or trivalent or more-valent carboxylic acid component. Examples of the component used for synthesis of the polyester resin include the following alcohol components and carboxylic acid components.

Specific examples of the divalent or trivalent or more-valent alcohol components include: diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; bisphenols, such as bisphenol A, hydrogenated bisphenol A, polyoxyethylene-modified bisphenol A, and polyoxypropylene-modified bisphenol A; and trivalent or more-valent alcohols, such as sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent or trivalent or more-valent carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, and malonic acid. Further, specific examples of the divalent carboxylic acid components include alkyl (or alkenyl) succinic acids, such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid. Specific examples of the trivalent or more-valent carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid. Each of these divalent or trivalent or more-valent carboxylic acid components may be acid halide, acid anhydride, or a derivative for ester formation (e.g., derivative for ester formation of a lower alkyl ester). The term, "lower alkyl" means an alkyl group with carbon atom of 1 to 6.

Where the binder resin is the polyester resin, the acid value of the polyester resin is preferably 10 mgKOH/g or higher and 40 mgKOH/g or lower. Where the acid value is too low, in preparing the toner by aggregation, which will be described later, aggregation of particulates of the components included in the toner is hard to favorably proceed. Where the acid value is too high, under a high humidity condition, various performance of the toner may be impaired due to the influence of the humidity. Further, the acid value of the polyester resin can be adjusted by adjusting the balance between a hydroxyl group included in an alcohol component and a carboxyl group included in a carboxylic acid component, which are used in synthesis of the polyester resin. It is noted that the acid value of the polyester resin is not particularly limited as long as $SP_c$, $SP_t$, and $SP_s$ satisfy the aforementioned predetermined relationships.

Where the polyester resin is used as the binder resin, $SP_c$ can be adjusted by adjusting the balance between the amount of the hydroxyl group included in the alcohol component and the amount of the carboxyl group included in the carboxylic acid component, which are used in synthesis of the polyester resin.

As the binder resin, besides sole use of a thermoplastic resin, a thermoplastic resin to which a cross-linking agent or a thermosetting resin is added can be used also. Introduction of a cross-linking structure into part of the binder resin can improve the preservation stability, shape retaining property, and durability of the toner without involving reduction in fixability of the toner.

As the thermosetting resin that can be used together with the thermoplastic resin, epoxy resin and cyanate-based resin are preferable. Specific examples of suitable thermosetting resin include bisphenol A type epoxy resin, hydrogenated bisphenol A type epoxy resin, novolac-type epoxy resin, poly (alkylene ether)-type epoxy resin, cyclic aliphatic-type epoxy resin, and cyanate resin. Two or more types of these thermosetting resins may be used in combination.

The glass transition point (Tg) of the binder resin is preferably 45° C. or higher and 70° C. or lower. Where Tg of the binder resin is too low, the toner may fuse in the interior of the development section in an image forming device or partially fuse in transport of a toner container or in storage of the toner container in a storehouse. Such toner fusion might be caused by reduction in preservation stability of the toner. Further, too low Tg of the binder resin may tend to cause reduction in strength of the binder resin and adhesion of the toner to the latent image bearing member. Where Tg of the binder resin is too high, the toner may be difficult to be favorably fixed at low temperature.

It is noted that the Tg of the binder resin can be obtained by a method in accordance with JIS K7121. For example, Tg of the binder resin can be obtained using a differential scanning calorimeter (DSC) from the point of variation of the specific heat of the binder resin. The detailed measurement method is as follows. For example, an endothermic curve of the binder resin is measured using a differential scanning calorimeter, "DSC-6200" by Seiko Instruments Inc. as a measurement device. Thus, Tg of the binder resin can be obtained from the measured endothermic curve. For measurement of the endothermic curve, a sample of 10 mg is put into an aluminum pan, while an empty aluminum pan is used as a reference. For example, the measurement is carried out under measurement conditions of a temperature range of 25° C. or higher and 200° C. or lower, a heating rate of 10° C./min., and normal temperature and normal humidity.

The melting point (Tm) of the binder resin is preferably 80° C. or higher and 120° C. or lower. Too high Tm of the binder resin may cause difficulty in favorable fixing of the toner at low temperature. Too low Tm of the binder resin may tend to cause the toner to aggregate in high temperature storage. Accordingly, too low Tm of the binder resin may tend to impair the heat resistant preservability of the toner.

The number average molecular weight (Mn) of the binder resin is preferably 1000 or higher and 4000 or lower, and more preferably 1500 or higher and 3000 or lower. Further, the mass average molecular weight (Mw) of the binder resin is preferably 1500 or higher and 11000 or lower, and more preferably 3500 or higher and 7000 or lower. In addition, the molecular weight distribution (Mw/Mn), which is expressed by a ratio between a number average molecular weight (Mn) and a mass average molecular weight (Mw), is preferably 2 or larger and 10 or smaller. Setting the molecular weight distribution of the binder resin to be 2 or larger and 10 or smaller can easily enhance the fixability of the toner at low temperature. Each of the number average molecular weight (Mn) and the mass average molecular weight (Mw) of the binder resin can be measured by gel permeation chromatography.

Preferably, $SP_c$ is 11.0 or larger and 12.0 or smaller. Setting $SP_c$ to be 11.0 or larger and 12.0 or smaller can make it easy to adjust $\Delta SP_1$ ($=SP_c-SP_t$) within the range of 0.3 or larger and 1.4 or smaller. It is noted that $SP_c$ is not particularly limited as long as $SP_c$, $SP_t$, and $SP_s$ satisfy the aforementioned predetermined relationships.

One example of a preferable method for producing the toner of the present disclosure may be aggregation, which will be described later. In producing the toner by aggregation, it is preferable to use, as the binder resin, polyester resin subjected to treatment to reduce the content of oligomers in the toner. The use of such polyester resin can make it easy to allow the toner core to include the releasing agent of a desire amount. In turn, the fixability of the toner at low temperature can be easily enhanced.

Hereinafter, polyester resin subjected to treatment to at least partially remove the oligomers contained in the polyester resin or treatment to reduce the production amount of the oligomers at the synthesis stage will be referred to as "low oligomer polyester resin".

Examples of a method for at least partially removing the oligomers with a molecular weight of 1000 or lower in the polyester resin include the following first and second methods. The first method is such that polyester resin crushed as necessary is treated with an aqueous solution of a basic substance. The second method is treatment using an organic solvent that can selectively dissolve a low molecular weight component (component with a molecular weight of 1000 or lower) in polyester resin. In order to increase the efficiency of removing the oligomers in the polyester resin, the first method is preferable. Examples of the basic substance include: alkali metal hydroxides, such as sodium hydroxide, potassium hydroxide, and lithium hydroxide; and alkali metal carbonates, such as sodium carbonate and potassium carbonate. Two or more types of the basic substances may be used in combination.

The amount of the oligomers with a molecular weight of 1000 or lower, which are derived from the polyester resin (binder resin) in the toner, is preferably 1000 mass ppm or lower relative to the mass of the toner. It is noted that the amount of the oligomers with a molecular weight of 1000 or lower in the polyester resin is not particularly limited.

<Method for Measuring Content of Oligomers in Toner (Methanol Extracting Method)>

The content A (mass ppm) of the oligomers with a molecular weight of 1000 or lower, which are derived from the binder resin in the toner, can be measured by a method including the following steps (1)-(3) of:

(1) obtaining a methanol extract including oligomers derived from the binder resin by putting 100 g of sample of electrostatic charge image developing toner and 500 g of methanol into a container and stirring the content in the container at 60° C. for 8 hours;

(2) measuring the mass B (g) of all the oligomers with a molecular weight of 1000 or lower in the methanol extract; and (3) calculating the content A of the oligomers with a molecular weight of 1000 or lower in the toner (ratio of oligomer to toner) by the following equation.

$$A=(B/100)\times 1000000 \text{ [mass ppm]}.$$

The amount of the oligomers with a molecular weight of 1000 or lower in the methanol extract can be analyzed by any known analysis method, such as infrared spectroscopy (IR), ultraviolet spectroscopy, nuclear magnetic resonance (NMR) spectrometry, high-performance liquid chromatography (HPLC), gel permeation chromatography (GPC), and mass spectrometry. It is preferable to measure the amount of the oligomers with a molecular weight of 1000 or lower by GPC among of them. A method for measuring the amount of oligomers with a molecular weight of 1000 or lower by GPC will be described below.

(Method for Measuring Amount of Oligomers with Molecular Weight of 1000 or Lower by GPC)

A sample is dissolved in tetrahydrofuran (THF) as a solvent. The concentration of the sample in THF is preferably 0.1 mg/ml or higher and 5 mg/ml or lower, more preferably 0.5 mg/ml or higher and 2 mg/ml or lower. The method for dissolving the sample in THF may be stirring the sample in THF or immersing the sample in THF in a ultrasonic bath. Then, the obtained THF solution is filtered using a sample treatment filter. Thus, a sample for GPC is obtained.

In GPC, the THF solution is allowed to flow at a flow rate of 0.35 ml/min in a state in which a column is stabilized at 40° C. A calibration curve is prepared using several types of monodispersed polystyrene. Then, using the prepared calibration curve, a distribution of the molecular weight in terms of styrene of the sample is measured. In order to increase the accuracy of the calibration curve, it is preferable to obtain at least 10 or more measurement values. As a detector, a refractive index (RI) detector or a ultraviolet (UV) ray detector may be used. The RI detector can perform detection regardless of the composition of a sample. As the column, a standard polystyrene gel column may be used.

For example, GPC is performed on monodispersed standard polystyrene with a number average molecular weight of 1000. Then, the retention volume (ml) at a peak point in the obtained GPC chromatogram is obtained. Hereinafter, the retention volume at the peak point is referred as RVS. Further, GPC is performed on the residue resulted from evaporation of a methanol component from the methanol extract. Then, the area ratio of a peak portion equal to or lower than RVS on the low molecular side to the total area of the peak in the obtained chromatogram is calculated. In so doing, a differential refractometer can be used as a detector, for example. Further, only an oligomer portion is separately fractionated by preparative liquid chromatography. Thereafter, the monomer composition of the obtained oligomer portion is analyzed by pyrolysis gas chromatography, infrared spectroscopy, or proton nuclear magnetic resonance spectroscopy. In so doing, where the monomer composition is just the same as the composition of the entire copolymer, it can be considered that there is no difference between the refractive index of the oligomer portion and the refractive index of the entire copolymer. Thus, the weight ratio can be obtained on the basis of the peak area ratio. Accordingly, calculation of the peak area rate of the chromatogram in terms of percentage can obtain the amount of the oligomers with a molecular weight of 1000 or lower on the basis of the calculated ratio. Examples of conditions for GPC will be indicated below.

<Conditions for GPC>

Apparatus: HLC-8320 (by TOSOH CORPORATION)

Eluent: THF (tetrahydrofuran)

Columns: TSK gel Super Multipore HZ-M (by TOSOH CORPORATION)

The number of columns: 3

Detector: RI

Flow rate of eluate: 0.35 milliliter/min

Concentration of sample: 2.0 g/liter

Temperature of columns: 40° C.

Amount of sample: 10 microliter

It is noted that the sample is prepared using eluent, for example. After shaking for one hour by a shaker, filtering using a filter (aperture diameter of 5 microns) is performed. Standard polystyrene is used for making a calibration curve.

Where the polyester resin is a resin synthesized using a monomer including an aromatic ring, such as polyoxyethylene-modified bisphenol A and polyoxypropylene-modified bisphenol A, it is preferable to measure the content of the oligomers with a predetermined molecular weight or smaller in methanol by high-performance liquid chromatography using a UV detector.

It is noted that the method for measuring the amount of oligomers with a molecular weight of 1000 or lower out of the oligomers included in the methanol extract is not limited particularly.

[Colorant]

The toner core may include colorant as necessary. As the colorant, any of known pigment and dyes can be used according to the color of the toner particles. Specific examples of suitable colorant that can be added to the toner include the following colorants.

One example of black colorant may be carbon black. Specifically, examples may be: Raven 1060, 1080, 1170, 1200, 1250, 1255, 1500, 2000, 3500, 5250, 5750, 7000, 5000 ULTRA II, and 1190 ULTRA II by COLUMBIAN CARBON COMPANY; Black Pearls L, Mogul-L, Regal 400R, 660R, and 330R, Monarch 800, 880, 900, 1000, 1300, and 1400 by Cabot Corporation; Color Black FW1, FW2, FW200, 18, S160, and S170, Special Black 4, 4A, and 6, and Printex 35, U, 140U, V, and 140V by Degussa AG; and No. 25, 33, 40, 47, 52, 900, and 2300, MCF-88, and MA600, 7, 8, and 100 by Mitsubishi Chemical Corporation. Further, as the black colorant, a colorant may be used which is toned black with the use of colorants, such as yellow colorant, magenta colorant, and cyan colorant, which will be described later. Examples of the colorant for color toner include yellow colorant, magenta colorant, and cyan colorant.

Examples of the yellow colorant include condensed azo compounds, isoindolinone compounds, anthraquinone compounds, azo metal complexes, methine compounds, and allylamide compounds. Specific examples include C.I. pigment yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples include C.I. pigment red 2, 3, 5, 6, 7, 19, 23, 48:2, 48:3, 48:4, 57;1, 81:1, 122, 144, 146, 150, 166, 169, 177, 184, 185, 202, 206, 220, 221, and 254.

Examples of the cyan colorant include copper phthalocyanine compounds, copper phthalocyanine derivatives, anthraquinone compounds, and basic dye lake compounds. Specific examples include C.I. pigment blue 1, 7, 15, 15:1, 15:2, 15:3, 15:4, 60, 62, and 66.

Any of the above described colorants may be used solely or in combination. The amount of use of the colorant is preferably 3% by mass or higher and 15% by mass or lower relative to the mass of the toner.

[Releasing Agent]

The toner core of the toner according to the present disclosure may include a releasing agent for the purpose of enhancing the fixability or offset resistance of the toner. The type of the releasing agent is not particularly limited as long as it is a releasing agent for toners.

Examples of a suitable releasing agent include: aliphatic hydrocarbon-based waxes, such as low molecular weight polyethylene, low molecular weight polypropylene, polyolefin copolymers, polyolefin wax, microcrystalline wax, paraffin wax, and Fischer-Tropsch wax; oxides of aliphatic hydrocarbon-based wax, such as polyethylene oxide wax and a block copolymer of polyethylene oxide wax; botanical waxes, such as candelilla wax, carnauba wax, vegetable wax, jojoba wax, and rice wax; animal waxes, such as beeswax, lanolin, and spermaceti; mineral waxes, such as ozokerite, ceresin, and petrolatum; waxes of which main component is a fatty acid ester, such as montanoic acid ester wax and castor wax; and waxes in which a fatty acid ester is partially or entirely deoxidized, such as deoxidized carnauba wax.

Examples of a releasing agent that can be suitably used include: saturated straight chain fatty acids, such as palmitic acid, stearic acid, montanoic acid, and long chain alkylcarboxylic acids with a long chain alkyl group; unsaturated fatty acids, such as brassidic acid, eleostearic acid, and parinaric acid; saturated alcohols, such as stearyl alcohol, eicosyl alcohol, behenyl alcohol, carnaubyl alcohol, ceryl alcohol, myricyl alcohol, and long chain alkyl alcohol with a long chain alkyl group; polyols, such as sorbitol; fatty acid amides, such as linoleic acid amide, oleic acid amide, and lauric acid amide; saturated fatty acid bisamides, such as methylenebis (stearic amide), ethylenebis(capric acid amide), ethylenebis (lauric acid amide), and hexamethylenebis(stearic amide); unsaturated fatty acid amides, such as ethylenebis(oleic acid amide), hexamethylenebis(oleic acid amide), N,N'-dioleyl (adipic acid amide), and N,N'-dioleyl(sebacic acid amide); aromatic bisamides, such as m-xylenebis(stearic acid amide) and N,N'-distearyl(isophthalic acid amide); fatty acid metal salts, such as calcium stearate, calcium laurate, zinc stearate, and magnesium stearate; waxes in which a vinyl-based monomer, such as styrene and acrylic acid, is grafted on an aliphatic hydrocarbon-based wax; partially esterified compounds of a fatty acid and a polyol, such as behenic acid monoglyceride; and methylester compounds with a hydroxyl group which is obtained by hydrogenation of vegetable oil.

The amount of use of the releasing agent is preferably 8% by mass or higher and 20% by mass or lower, and more preferably 10% by mass or higher and 15% by mass or lower relative to the mass of the toner. Too small amount of use of the releasing agent may obtain no desired effect in prevention of offset or image smearing in a formed image. By contrast, too large amount of use of the releasing agent may fuse the toner to reduce the preservation stability of the toner.

[Charge Control Agent]

The toner core of the toner according to the present disclosure may include a charge control agent, as necessary. The charge control agent can enhance stability of the charge level or charge rise characteristics of the toner. The charge rise characteristics serve as an index as to whether or not the toner can be charged to a predetermined charge level within a short period of time. Addition of the charge control agent to the toner core can enhance the durability or stability of the toner. Where the toner is positively charged for development, a positively chargeable charge control agent is used. Where the toner is negatively charged for development, a negatively chargeable charge control agent is used.

The type of the charge control agent can be appropriately selected from charge control agents for toners. Specific examples of the positively chargeable charge control agent include: azine compounds, such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes made of an azine compound, such as azine fast red FC, azine fast red 12BK, azine violet BO, azine brown 3G, azine light brown GR, azine dark green BH/C, azine deep black EW, and azine deep black 3RL; nigrosine compounds, such as nigrosine, nigrosine salts, and nigrosine derivatives; acid dyes made of a nigrosine compound, such as nigrosine BK, nigrosine NB, and nigrosine Z; metal salts of naphthenic acid or higher fatty acid; alkoxylated amine; alkylamide; and quaternary ammonium salts, such as benzylmethylhexyldecylammonium and decyltrimethylammonium chloride. In order to further quick rise characteristics, the nigrosine compounds are particularly preferable. Two or more of the aforementioned positively chargeable charge control agents may be used in combination.

Resins with a quaternary ammonium salt, a carboxylic acid salt, or a carboxyl group as a functional group may be used as the positively chargeable charge control agent. More specific examples include styrene-based resin with a quaternary ammonium salt, acrylic resin with a quaternary ammonium salt, styrene-acrylic resin with a quaternary ammonium salt, polyester resin with a quaternary ammonium salt, styrene-based resin with a carboxylic acid salt, acrylic resin with a carboxylic acid salt, styrene-acrylic resin with a carboxylic acid salt, polyester resin with a carboxylic acid salt, styrene-based resin with a carboxyl group, acrylic resin with a carboxyl group, styrene-acrylic resin with a carboxyl group, and polyester resin with a carboxyl group. These resins may be oligomers or polymers.

Of the resins that can be used as the positively chargeable charge control agent, the styrene-acrylic resin with a quaternary ammonium salt as a functional group is more preferable since the use of such a resin can result in easy adjustment of the charge amount of the toner within a desired range. Specific examples of a preferable acrylic copolymer for copolymerization with a styrene unit in producing the styrene-acrylic resin with a quaternary ammonium salt as a functional group include alkyl (meth)acrylate esters, such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Further, as the quaternary ammonium salt, a unit is used which is derived from dialkylaminoalkyl (meth)acrylate, dialkylamino (meth)acrylamide, or dialkylaminoalkyl (meth) acrylamide through quaternization. Examples of the dialkylaminoalkyl (meth)acrylate include dimethylaminoethyl (meth)acrylate, diethylaminoethyl (meth)acrylate, dipropylaminoethyl (meth)acrylate, and dibutylaminoethyl (meth) acrylate. One specific example of the dialkyl (meth)acrylamide may be dimethylmethacrylamide. One specific example of the dialkylaminoalkyl (meth)acrylamide may be dimethylaminopropylmethacrylamide. Further, a hydroxy group containing polymerizable monomer may be used in combination in polymerization, such as hydroxyethyl (meth)acrylate, hydroxypropyl (meth)acrylate, 2-hydroxybutyl (meth)acrylate, and N-methylol (meth)acrylamide.

Specific examples of the negatively chargeable charge control agent include organic metal complexes and chelate compounds. As the organic metal complexes and the chelate compounds, acetylacetone metal complexes, such as aluminum acetylacetonate and iron(II) acetylacetonate; and salicylic acid-based metal complexes or salicylic acid-based metal salts, such as 3,5-di-tert-butylsalicylic acid chromium are preferable. Among of them, salicylic acid-based metal complexes and salicylic acid-based metal salts are more preferable. Two or more of these negatively chargeable charge control agents can be used in combination.

The amount of use of the positively or negatively chargeable charge control agent is preferably 1.5 parts by mass or more and 15 parts by mass or less, more preferably 2.0 parts by mass or more and 8.0 parts by mass or less, and particularly preferably 3.0 parts by mass or more and 7.0 parts by mass or less when the total mass of the toner is 100 parts by mass. Too small amount of use of the charge control agent may cause difficulty in stable charging of the toner to a predetermined polarity. Accordingly, the image density of a formed image may be lower than a desired value, or it may be difficult to maintain the image density for a long period of time in some cases. Further, too small amount of use of the charge control agent may cause difficulty in uniform dispersion of the charge control agent in the toner. Accordingly, fagging may tend to be caused on a formed image, or contamination on a latent image bearing member, which may be caused due to adhesion of the toner components, may tend to be caused. Where the amount of use of the charge control agent is too large, resistance to environment of the toner may tend to reduce. Accordingly, image defect, which may be caused due to charge failure at high temperature and high humidity, may tend to be caused, or contamination on the latent image bearing member, which may be caused due to adhesion of the toner components, may tend to be caused.

[Shell Layer]

In view of the fact that it is easy to adjust the SP value ($SP_t$) of the material for the inner layer and the SP value ($SP_s$) of the material for the outer layer, resin is preferable as the material for the shell layer. It should be noted that the shell layer that forms the toner according to the present disclosure includes the inner layer and the outer layer. The material for the shell layer is not particularly limited as long as all of the followings are satisfied: it can form the inner layer and the outer layer; the first SP value difference ($SP_c-SP_t$) is 0.3 or larger and 1.4 or smaller; the second SP value difference ($SP_t-SP_s$) is 0.5 or larger and 1.6 or smaller; and the relationship of $SP_c-SP_t<SP_t-SP_s$ holds. The inner layer and the outer layer of the shell layer will be described below.

[Inner Layer]

In view of easy adjustment of $SP_t$, the material for the inner layer is preferably one or more types of resin selected from the group consisting of (meth)acrylic resin, styrene-(meth) acrylic resin, and polyester resin. Further, in view of easy adjustment of $\Delta SP_1$ or $\Delta SP_2$ within a predetermined range, the resin forming the inner layer is preferably polyester resin. Examples of polyester resin that can be suitably used as the resin forming the inner layer include various types of polyester resin as listed above as the example of the binder resin. It is noted that the material for the inner layer is not particularly limited as long as $SP_c$, $SP_t$, and $SP_s$ satisfy the above predetermined relationships.

Description will be made below about (meth)acrylic resin and styrene-(meth)acrylic resin used as the resin forming the inner layer.

((Meth)acrylic Resin)

As a resin forming the inner layer, a (meth)acrylic resin can be used which can be obtained by polymerization of a monomer including at least a (meth)acrylic monomer, for example. Examples of the (meth)acrylic monomer used for preparing the (meth)acrylic resin include: (meth)acrylic acid; alkyl (meth)acrylates, such as methyl (meth)acrylate, ethyl (meth) acrylate, and propyl (meth)acrylate; and (meth)acrylamide compounds, such as (meth)acrylamide, N-alkyl (meth)acrylamide, N-aryl (meth)acrylamide, N,N-dialkyl (meth)acrylamide, and N,N-diaryl (meth)acrylamide.

Preferably, the (meth)acrylic resin includes a carboxyl group included in a unit derived from (meth)acrylic acid as an acidic group. In such a (meth)acrylic resin, an increase/decrease in amount of use of the (meth)acrylic acid in preparing the (meth)acrylic resin can adjust the acid value of the (meth) acrylic resin and SPt.

Where the (meth)acrylic resin is a resin in which a monomer (another monomer) other than the (meth)acrylic monomer is copolymerized, examples of the other monomer include: olefins, such as ethylene, propylene, butene-1, pentene-1, hexene-1, heptene-1, and octene-1; allyl esters, such as allyl acetate, allylic benzoate, allyl acetoacetate, and allyl lactate; vinyl ethers, such as hexylvinyl ether, octylvinyl ether, ethylhexyl vinyl ether, methoxyethyl vinyl ether, ethoxyethyl vinyl ether, chloroethyl vinyl ether, 2-ethylbutyl vinyl ether, dimethylaminoethyl vinyl ether, diethylaminoethyl vinyl ether, benzyl vinyl ether, vinyl phenyl ether, vinyl tolyl ether, vinyl chlorophenyl ether, vinyl-2,4-dichlorophenyl ether, and vinyl naphthyl ether; vinylesters, such as vinylacetate, vinyl propionate, vinyl butyrate, vinyl isobutyrate, vinyl diethyl acetate, vinyl chloro-acetate, vinyl methoxy acetate, vinyl butoxy acetate, vinyl phenyl acetate, vinyl acetoacetate, vinyl lactate, vinyl benzoate, vinyl salicylate, vinyl chlorobenzoate, and vinyl naphthoic acid.

Similarly to the resin that can be used as the aforementioned charge control agent, a chargeable functional group, such as a quaternary ammonium salt may be introduced into the (meth)acrylic resin.

The content (total) of the unit derived from the (meth) acrylic monomer in the (meth)acrylic resin is preferably 80% by mass or higher, more preferably 90% by mass or higher, and particularly preferably 100% by mass. It is noted that the content of the unit is not particularly limited within the scope not adversely affecting the purpose of the present disclosure.

(Styrene-(meth)acrylic Resin)

As a resin forming the inner layer, a styrene-(meth)acrylic resin can be used which can be obtained by copolymerization of monomers including at least a styrene-based monomer and a (meth)acrylic monomer.

Examples of the styrene-based monomer that can be used for preparing the styrene-(meth)acrylic resin include styrene, α-methylstyrene, o-methylstyrene, m-methylstyrene, p-methylstyrene, p-ethylstyrene, 2,4-dimethyl styrene, p-n-butylstyrene, p-dodecylstyrene, p-methoxystyrene, p-phenylstyrene, and p-chlorostyrene.

Examples of the (meth)acrylic monomer that can be used for preparing the styrene-(meth)acrylic resin include each monomer previously listed as the examples of the (meth) acrylic monomer that can be used for preparing the (meth) acrylic resin. Further, the styrene-(meth)acrylic resin preferably includes a carboxyl group included in the unit derived from the (meth)acrylic acid as an acidic group.

Where the styrene-(meth)acrylic resin is a resin which is copolymerized with a monomer (another monomer) other than the styrene-based monomer and the (meth)acrylic monomer, examples of the other monomer include each monomer previously listed as the examples of the monomer other than the (meth)acrylic monomer in the (meth)acrylic resin.

The content (total) of the unit derived from the styrene-based monomer and the unit derived from the (meth)acrylic monomer in the styrene-(meth)acrylic resin is preferably 80% by mass or higher, more preferably 90% by mass or higher, and particularly preferably 100% by mass It is noted that such the content of the unit is not particularly limited within the scope not adversely affecting the present disclosure.

Similarly to the aforementioned resin that can be used as the charge control agent, a chargeable functional group, such as a quaternary ammonium salt may be introduced into the styrene-(meth)acrylic resin.

The melting point (Tm) of the resin forming the inner layer is preferably 80° C. or higher and 120° C. or lower, more preferably 85° C. or higher and 110° C. or lower, and particularly preferably 90° C. or higher and 100° C. or lower. Too high Tm of the resin forming the inner layer may cause difficulty in favorable fixing of the toner at low temperature. Too low Tm of the resin forming the inner layer may impair the heat resistant preservability of the toner. The melting point Tm of the resin forming the inner layer can be measured by the same method as the above described method for measuring Tm of the binder resin.

The glass transition point (Tg) of the resin forming the inner layer is preferably 45° C. or higher and 60° C. or lower, and more preferably 50° C. or higher and 55° C. or lower. Too low Tg of the resin forming the inner layer may cause aggregation of the toner particles in a high temperature and high humidity environment. By contrast, too high Tg of the resin forming the inner layer may cause difficulty in suitable fixing of the toner at low temperature. The grass transition point Tg of the resin forming the inner layer can be measured by the same method as the above described method for measuring Tg of the binder resin.

The number average molecular weight (Mn) of the resin forming the inner layer is preferably 1000 or higher and 4000 or lower, and more preferably 1500 or higher and 3000 or lower. Further, the mass average molecular weight (Mw) of the resin forming the inner layer is preferably 1500 or higher and 11000 or lower, and more preferably 3500 or higher and 7000 or lower. Moreover, the molecular weight distribution (Mw/Mn), which is expressed by a ratio between a number average molecular weight (Mn) and a mass average molecular weight (Mw), is preferably 2 or larger and 10 or smaller. The number average molecular weight (Mn) and the mass average molecular weight (Mw) of the resin forming the inner layer can be measured by gel permeation chromatography, for example.

The SP value of the material for the inner layer, $SP_t$, is preferably 9.5 or larger and 11.5 or smaller. Setting $SP_t$ to be 9.5 or larger and 11.5 or smaller can achieve easy adjustment of $\Delta SP_1$ to be 0.3 or larger and 1.4 or smaller and easy adjustment of $\Delta SP_2$ to be 0.5 or larger and 1.6 or smaller. Further, setting $SP_t$ to be 9.5 or larger and 11.5 or smaller can achieve favorable attachment of the inner layer of the shell layer to the toner core and favorable attachment of the outer layer to the inner layer of the shell layer. Accordingly, the mechanical strength of the toner can be easily increased. It is noted that $SP_t$ is not particularly limited as long as $SP_c$, $SP_t$, and $SP_s$ satisfy the aforementioned predetermined relationships.

The mass of the inner layer is preferably 10 parts by mass or more and 35 parts by mass or less relative to 100 parts by mass of the binder resin in the toner core. It is noted that the mass of the inner layer is not particularly limited within the scope not adversely affecting the purpose of the present disclosure.

[Outer Layer]

In view of easy adjustment of $SP_s$, the material for the outer layer is preferably one or more types of resin selected from the group consisting of (meth)acrylic resin, styrene-(meth) acrylic resin, and polyester resin. Further, in view of the fact that toner excellent in heat resistant preservability can be easily obtained, the material for the outer layer is more preferably one or more types of resin selected from the group consisting of (meth)acrylic resin and styrene-(meth)acrylic resin. Examples of the polyester resin that can be suitably used as the resin forming the outer layer include each polyester resin previously listed as the examples of the binder resin. Moreover, examples of the (meth)acrylic resin and the styrene-(meth)acrylic resin that can be suitably used as the resin forming the outer layer include each resin previously listed as the examples of the resin forming the inner layer. It is noted that the material for the outer layer is not particularly limited as long as $SP_c$, $SP_t$, and $SP_s$ satisfy the aforementioned predetermined relationships.

The melting point (Tm) of the resin forming the outer layer is preferably 95° C. or higher and 140° C. or lower, more preferably 100° C. or higher and 130° C. or lower, and further preferably 105° C. or higher and 125° C. or lower. Too high Tm of the resin forming the outer layer may cause difficulty in favorable fixing of the toner at low temperature. Too low Tm of the resin forming the outer layer may impair the heat resistant preservability of the toner. The melting point Tm of the resin forming the outer layer can be measured by the same method as the above described method for measuring Tm of the binder resin.

The glass transition point (Tg) of the resin forming the outer layer is preferably 45° C. or higher and 80° C. or lower, more preferably 60° C. or higher and 70° C. or lower, and further preferably 63° C. or higher and 68.5° C. or lower. Too low Tg of the resin forming the outer layer may cause aggregation of the toner particles in a high temperature and high humidity environment. Too high Tg of the resin forming the outer layer may cause difficulty in favorable fixing of the toner at low temperature. The glass transition point Tg of the resin forming the outer layer can be measured by the same method as the above described method for measuring Tg of the binder resin.

The number average molecular weight (Mn) of the resin forming the outer layer is preferably 3000 or higher and 1000000 or lower, and more preferably 4500 or higher and 500000 or lower. Moreover, the molecular weight distribution (Mw/Mn), which is expressed as a ratio between a number average molecular weight (Mn) and a mass average molecular weight (Mw), is preferably 2 or larger and 30 or smaller, and more preferably 3 or larger and 10 or smaller. The number average molecular weight (Mn) and the mass average molecular weight (Mw) of the resin forming the outer layer can be measured by gel permeation chromatograph, for example.

The SP value of the material for the outer layer, $SP_s$, is preferably 8.0 or larger and 10.0 or smaller. Setting $SP_s$ to be 8.0 or larger and 10.0 or smaller can achieve easy adjustment of $\Delta SP_2$ to be 0.5 or larger and 1.6 or smaller. Further, setting $SP_s$ to be 8.0 or larger and 10.0 or smaller can achieve favorable attachment of the outer layer to the inner layer of the shell layer and in turn can easily increase the mechanical strength of the toner. It is noted that $SP_s$ is not particularly limited as long as $SP_c$, $SP_t$, and $SP_s$ satisfy the aforementioned predetermined relationships.

The mass of the outer layer is preferably 15 parts by mass or more and 50 parts by mass or less relative to 100 parts by mass of the binder resin in the toner core.

[External Additive]

As desired, the surface of the toner according to the present disclosure may be treated with an external additive. Hereinafter, toner particles before treated with an external additive will be referred to as "toner base particles". Specific examples of a suitable external additive include metal oxides, such as alumina, titanium oxide, magnesium oxide, zinc oxide, strontium titanate, and barium titanate, and silica. Two or more external additives may be used in combination. Further, any of these external additives may be hydrophobized for use by a hydrophobizing agent, such as an aminosilane coupling agent and silicone oil. Where a hydrophobized external additive is used, a decrease in charge amount of the toner can be easily prevented at high temperature and high humidity, and the fluidity of the toner can be easily increased. It is noted that the type of the external additive can be appropriately selected from external additives for toners.

The particle diameter of the external additive is preferably 0.01 μm or larger and 1.0 μm or smaller.

The amount of use of the external additive is preferably 0.1 parts by mass or more and 10 parts by mass or less, and more preferably 0.2 parts by mass or more and 5 parts by mass or less relative to 100 parts by mass of the toner base particles.

[Carrier]

The toner according to the present disclosure may be mixed with a desired carrier to be used as a two-component developer. Where the two-component developer is prepared, it is preferable to use a magnetic carrier.

One example of a suitable carrier, where the toner of the present disclosure is used as a two-component developer, may be a carrier having a carrier core covered with a resin. Specific examples of the carrier core include particles of iron, oxidized iron, reduced iron, magnetite, copper, silicon steel, ferrite, nickel, or cobalt, and particles of an alloy of any of these materials and manganese, zinc, or aluminum; particles of an iron-nickel alloy or an iron-cobalt alloy; particles of ceramics, such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; particles of a high dielectric substance, such as ammonium dihydrogen phosphate, potassium dihydrogen phosphate, and Rochelle salt; and a resin carrier in which any of the above particles as magnetic particles are dispersed in the resin.

Specific examples of the resin that covers the carrier core include (meth)acrylic polymer, styrene-based polymer, styrene-(meth)acrylic copolymer, olefin-based polymer (polyethylene, chlorinated polyethylene, and polypropylene), polyvinyl chloride, polyvinyl acetate, polycarbonate, cellulose resin, polyester resin, unsaturated polyester resin, polyamide resin, polyurethane resin, epoxy resin, silicone resin, fluororesin (polytetrafluoroethylene, polychlorotrifluoroethylene, and polyvinylidene fluoride), phenolic resin, xylene resin, diallyl phthalate resin, polyacetal resin, and amino resin. Two or more of these resins can be used in combination.

The particle diameter of the carrier is preferably 20 μm or larger and 120 μm or smaller, and more preferably 25 μm or larger and 80 μm or smaller where the particle diameter is measured with an electron microscope.

Where the toner according to the present disclosure is used as a two-component developer, the content of the toner in the two-component developer is preferably 3% by mass or higher and 20% by mass or lower, and more preferably 5% by mass or higher and 15% by mass or lower relative to the mass of the two-component developer. Setting the content of the toner in the two-component developer to be 3% by mass or higher and 20% by mass or lower can achieve easy maintenance of the image density at an appropriate level in image formation and easy prevention of contamination in the interior of an image forming device, and of adhesion of the toner to transfer paper, which may be caused by toner scattering from the development device.

[Method for Producing Electrostatic Charge Image Developing Toner]

Aggregation is preferable as a method for producing the electrostatic charge image developing toner of the present disclosure in view of the fact that toner particles having uniform shape can be easily obtained, or that the shell layer with uniform thickness can be easily formed on the surface of the toner core. A method for producing the electrostatic charge image developing toner which employs aggregation will be described below. However, the aggregation is not limited to the following method. Variable methods employable as a toner producing method can be applied.

A suitable toner producing method employing aggregation includes Steps (I)-(VI), for example. Steps (I)-(VI) will be described below sequentially.

In Step (I), an aqueous medium dispersion solution (A) in which particulates including the binder resin are dispersed is obtained. Thereafter, the particulates in the solution are allowed to aggregate in the presence of a coagulant. This can obtain an aqueous medium dispersion solution (B) in which the toner core is dispersed.

In Step (II), an aqueous medium dispersion solution (C) is mixed with the aqueous medium dispersion solution (B) to obtain an aqueous medium dispersion solution (D). The toner cores are dispersed in the aqueous medium dispersion solution (B). Particulates including the resin used for forming the inner layer of the shell layer are dispersed in the aqueous medium dispersion solution (C). The toner cores and the particulates including the resin used for forming the inner layer of the shell layer are dispersed in the aqueous medium dispersion solution (D).

In Step (III), the aqueous medium dispersion solution (D) is heated to obtain an aqueous medium dispersion solution (E) including the toner core. A covering layer I formed of the particulates including the resin used for forming the inner layer of the shell layer is formed on the surface of the toner core in the aqueous medium dispersion solution (E).

In Step (IV), an aqueous medium dispersion solution (F) is mixed with the aqueous medium dispersion solution (E) to obtain an aqueous medium dispersion solution (G). The toner cores including the covering layer I are dispersed in the aqueous medium dispersion solution (E). Particulates including the resin used for forming the outer layer of the shell layer are dispersed in the aqueous medium dispersion solution (F). The toner cores including the covering layer I and the particulates including the resin used for forming the outer layer of the shell layer are dispersed in the aqueous medium dispersion solution (G).

In Step (V), the aqueous medium dispersion solution (G) is heated to obtain an aqueous medium dispersion solution (H) including the toner cores. The covering layer I is formed on the surface of the toner core in the aqueous medium dispersion solution (H). Further, the outer surface of the covering layer I is covered with a covering layer II formed of the particulates including the resin used for forming the outer layer of the shell layer.

In Step (VI), the aqueous medium dispersion solution (H) is heated to form the shell layer on the surface of the toner core. The shell layer includes the inner layer and the outer layer.

The method for producing the electrostatic charge image developing toner in the present disclosure may include the following steps (VII)-(IX), as necessary, in addition to the above steps (I)-(VI).

(VII): washing step of washing the toner (VIII): drying step of drying the toner (IX): externally adding step of attaching an external additive to the surface of the toner base particles Steps (I)-(IX) will be described below sequentially.

[Step (I)]

In step (I), the aqueous medium dispersion solution (A) of the particulates including the binder resin is obtained. Thereafter, the particulates in the solution are allowed to aggregate in the presence of the coagulant. This can obtain the aqueous medium dispersion solution (B) including the toner cores. A method for preparing the aqueous medium dispersion solution (A) of the particulates including the binder resin and a particulate aggregating method will be described below.

<Method for Preparing Aqueous Medium Dispersion Solution (A) of Particulates Including Binder Resin>

The method for preparing the aqueous medium dispersion solution (A) of the particulates including the binder resin is not particularly limited. The particulates including the binder resin may include only the binder resin or include any optional component, such as colorant, a releasing agent, and a charge control agent in addition to the binder resin. Only the binder resin or the composition including the binder resin and the above described optional component is/are made to be particulates with desired size in the aqueous medium. This can prepare an aqueous medium dispersion solution (A) of the particulates including the binder resin.

The aqueous medium dispersion solution (A) of the particulates including the binder resin may include particulates other than the particulates including the binder resin. Examples of the particulates other than the particulates including the binder resin include particulates of a releasing agent and particulates of colorant. Description will be made below sequentially about a method for preparing the particulates including the binder resin, a method for preparing particulates of a releasing agent, a method for preparing particulates of colorant, and a method for preparing particulates including the binder resin and a releasing agent. It is noted that a method almost the same as the following method can prepare particulates including a component other than the above components.

(Method for Preparing Particulates Including Binder Resin)

A suitable example of the method for preparing the particulates including the binder resin will be described below.

First, the binder resin is heated up to a temperature equal to or higher than the melting point (Tm) of the binder resin to melt the binder resin. This can obtain a melt of the binder resin. The temperature to melt of the binder resin is preferably the melting point of the binder resin plus 10° C. or higher and plus 30° C. or lower. However, the temperature to melt the binder resin is not particularly limited as long as the binder resin can be melted uniformly.

Where polyester resin is used as the binder resin, a basic substance may be added to the binder resin in a melted state in order to neutralize an acid group included in the polyester resin. Examples of a suitable basic substance include: alkali metal hydroxides, such as sodium hydroxide, potassium hydroxide, and lithium hydroxide; alkali metal carbonates, such as sodium carbonate and potassium carbonate; alkali metal hydrogencarbonates, such as sodium hydrogencarbonate and potassium hydrogencarbonate; and nitrogen containing organic bases, such as N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine, and vinylpyridine. One of the basic compounds may be used solely. Or, two or more of the basic compounds may be used in combination. It is noted that the basic substance is not particularly limited within the scope not adversely affecting the purpose of the present disclosure as long as the acid group included in the polyester resin can be neutralized.

The amount of use of the basic compound can be appropriately determined with the acid value of the polyester resin taken into consideration. The amount of use of the basic compound is preferably 1 part by mass or more and 20 parts by mass or less, and more preferably 5 parts by mass or more and 15 parts by mass or less relative to 100 parts by mass of the binder resin.

Further, a surfactant may be added to the melt of the binder resin. Addition of the surfactant to the melt of the binder resin enables stable dispersion of the particulates of the binder resin in the aqueous medium.

The surfactant added to the melt of the binder resin can be appropriately selected from the group consisting of anion-based surfactant, cation-based surfactant, and nonion-based surfactant. Examples of the anion-based surfactant include sulfuric ester salt type surfactants, sulfonate type surfactants, phosphate ester salt type surfactants, and soap. Examples of the cation-based surfactant include amine salt type surfactants and quaternary ammonium salt type surfactants. Examples of the nonion-based surfactant include: polyethylene glycol type surfactants; alkyl phenol ethylene oxide adjunct type surfactant; and polyol alcohol type surfactants as polyol derivatives, such as glycerin, sorbitol, and sorbitan. Among these surfactants, it is preferable to use at least one of the anion-based surfactant and the nonion-based surfactant. One of the surfactants may be used solely. Or, two or more of the surfactants may be used in combination. The surfactant added to the melt of the binder resin is not particularly limited.

The amount of use of the surfactant is preferably 1% by mass or higher and 10% by mass or lower relative to the mass of the binder resin.

Water is added to the melt of the binder resin prepared as above. Then, they are stirred and mixed, thereby preparing an aqueous medium dispersion solution including the particulates including the binder resin. In order to maintain the melted state of the binder resin, it is preferable to use a stirrer having a function of keeping the temperature of the content in the stirrer in stirring the melt of the binder resin and the water. As a suitable method for keeping the temperature of the content in the stirrer may be a method in which using a stirrer with a jacket, warm water, vapor, or heat medium oil, at a predetermined temperature, is allowed to flow in the jacket. One example of a suitable stirrer may be a heating kneader ("TK HIVIS DISPER MIX HM-3D-5" by PRIMIX Corporation).

The aqueous medium dispersion solution including the particulates including the binder resin can be obtained by stirring the melt including the binder resin and water. The particle size of the particulates including the binder resin, which are included in the solution, can be adjusted by adjusting the stirring rate in mixing the melt of the binder resin and water. The volume average particle diameter ($D_{50}$) of the particulates including the binder resin is preferably 1 μm or smaller, more preferably 0.05 μm or larger and 0.5 μm or smaller. Where the particle diameter of the particulates including the binder resin is 1 μm or smaller, a sharp distribution of the particle diameter of the toner can be easily obtained. Further, the shape of the toner can be easily uniformed. Moreover, variation in performance and productivity of the toner can be reduced. The volume average particle diameter ($D_{50}$) of the particulates including the binder resin can be measured using a laser diffraction/scattering type particle size distribution analyzer (e.g., "LA-950" by HORIBA, Ltd.).

(Preparation of Particulates Including Releasing Agent)

A suitable method for preparing particulates including a releasing agent will be described below. It is noted that the method for preparing particulates including a releasing agent is not limited to the below described method.

First, the releasing agent is crushed to be about 100 μm or smaller in advance. This can obtain powder of the releasing agent. Next, the powder of the releasing agent is added to an aqueous medium including a surfactant, thereby preparing slurry. Then, the obtained slurry is heated to a temperature equal to or higher than the melting point (Tm) of the releasing agent. Subsequently, strong shear force is applied to the heated slurry by a homogenizer or a pressure discharge type disperser. This can prepare an aqueous medium dispersion solution including the particulates including the releasing agent.

Examples of the device to apply strong shear force to the dispersion solution include NANO3000 (by BE RYU, LTD.), Nanomizer (YOSHIDA KIKAI CO., LTD.), Microfluidizer (by MFI), Gaulin homogenizer (by Manton-Gaulin), and CLEARMIX W-MOTION (by M Technique Co., Ltd.).

The volume average particle diameter ($D_{50}$) of the particulates including the releasing agent included in the aqueous medium dispersion solution is preferably 1 μm or smaller, and more preferably 0.1 μm or larger and 0.7 μm or smaller. The use of the particulates including the releasing agent with a particle diameter of 1 μm or smaller can easily obtain toner in which the releasing agent is uniformly dispersed in the binder resin. The volume average particle diameter ($D_{50}$) of the particulates including the releasing agent can be measured by the same method as the method for measuring the volume average particle diameter ($D_{50}$) of the particulates including the binder resin.

(Preparation of Particulates Including Colorant)

An example of a suitable method for preparing particulates including colorant will be described below. The method for preparing particulates including colorant is not limited to the below described method.

The colorant is put into an aqueous medium including a surfactant and is subjected to dispersion treatment using a known disperser. This can obtain particulates including the colorant. As needed, a component (dispersant) or the like to disperse the colorant may be added to the aqueous medium. The type of the surfactant is not particularly limited. Any of anion-based surfactants, cation-based surfactants, and non-ion-based surfactants can be used. The amount of use of the surfactant is preferably equal to or larger than the critical micelle concentration (CMC). It is noted that the amount of use of the surfactant is not particularly limited.

As the disperser used for dispersion treatment, there may be used a ultrasonic disperser; pressure type dispersers, such as a mechanical homogenizer, a Manton-Gaulin, and a pressure type homogenizer; and medium type dispersers, such as a sand grinder, horizontal and vertical type bead mills, ULTRA APEX MILL (by KOTOBUKI INDUSTRIES CO., LTD.), DYNO-MILL (by Willy A. Bachofen AG), and MSC mill (NIPPON COKE & ENGINEERING CO., LTD.). It is noted that the disperser used for dispersion treatment is not particularly limited.

The volume average particle diameter ($D_{50}$) of the particulates including the colorant is preferably 0.05 μm or larger and 0.2 μm or smaller.

(Method for Preparing Particulates Including Binder Resin and Releasing Agent)

One example of a suitable method for preparing particulates including a binder resin and a releasing agent will be described below.

When the melt of the binder resin is allowed to include a releasing agent in the above described suitable method for preparing particulates including a binder resin, the particulates including the binder resin and the releasing agent can be prepared by almost the same method as the suitable method for preparing particulates including a binder resin.

Examples of a suitable method for allowing the melt of the binder resin to include the releasing agent include the following methods (a)-(c).

(a) method in which the binder resin and the releasing agent each in a solid state are mixed together, followed by melting the obtained mixture.

(b) method in which the releasing agent is heated to be melted, the binder resin is added to the melted releasing agent, and then they are heated and melted.

(c) method in which after the binder resin is heated to be melted, the releasing agent is added to the melted binder resin, and then they are heated and melted.

It is noted that the particulates including a binder resin, colorant, and a releasing agent can be prepared by the same method as any of the above methods except that the components blended with the binder resin are changed.

<Particulate Aggregating Method>

The particulates prepared by the above methods are appropriately combined so that the toner includes a predetermined component, thereby obtaining the toner cores as aggregated particulates. A suitable method for particulate aggregation may be a method in which a coagulant is added to an aqueous medium dispersion solution of the particulates.

Examples of the coagulant include inorganic metal salts, inorganic ammonium salts, and divalent or more-valent metal complexes. Examples of the inorganic metal salts include: metal salts, such as sodium sulfate, sodium chloride, calcium chloride, calcium nitrate, balium chloride, magnesium chloride, zinc chloride, aluminum chloride, and aluminum sulfate; and inorganic metal salt polymers, such as poly-aluminum chloride and poly-aluminum hydroxide. Examples of the inorganic ammonium salts include ammonium sulfate, ammonium chloride, and ammonium nitrate. Further, a quaternary ammonium salt type cationic surfactant and a polyethyleneimine may be used as the coagulant.

As the coagulant, any of divalent and monovalent metal salts may be used preferably. It is preferable to use a divalent metal salt and a monovalent metal salt in combination. Since the speed of particulate aggregation is different between the divalent metal salts and the monovalent metal salts, the combinational use of them can control the particle diameter of the toner core and can easily make the particle distribution to be sharp.

The additive amount of the coagulant is preferably 0.1 mmol/g or larger and 10 mmol/g or smaller relative to the solid content of the aqueous medium dispersion solution including the particulates. Further, it is preferable to appropriately adjust the adding amount of the coagulant according to the type or amount of the surfactant in the aqueous medium dispersion solution including the particulates.

It is preferable to add the coagulant at a temperature equal to or lower than the glass transition point of the binder resin after pH adjustment of the aqueous medium dispersion solution including the particulates. Where polyester resin is used as the binder resin of the toner, it is preferable to add the coagulant after the pH of the aqueous medium dispersion solution including the particulates is adjusted toward alkaline pH (preferably pH 10 or higher). By such a method, the particulates may tend to uniformly aggregate, and the distribution of the particle diameter of the toner core may tend to be sharp. The coagulant may be added at one time or successively.

It is preferable to add an aggregation terminating agent after aggregation proceeds up to the time when the toner core as aggregated particulates has a predetermined particle diameter. Examples of the aggregation terminating agent include sodium chloride and sodium hydroxide. Thus, the aqueous medium dispersion solution (B) including the toner cores can be obtained. It is noted that the condition for addition of the coagulant is not particularly limited as long as aggregation of the particulates proceeds favorably.

[Step (II)]

In Step (II), the aqueous medium dispersion solution (C) including particulates including the resin used for forming the inner layer of the shell layer is mixed with the aqueous medium dispersion solution (B) obtained in Step (I). This can obtain the aqueous medium dispersion solution (D) including the toner cores and the particulates including the resin used for forming the inner layer of the shell layer. Description will be made below about a suitable method for preparing the aqueous medium dispersion solution (C) including the particulates including the resin used for forming the inner layer of the shell layer. However, the method for mixing the aqueous medium dispersion solution (C) with the aqueous medium dispersion solution (B) is not particularly limited within the scope not adversely affecting the purpose of the present disclosure.

<Preparation of Aqueous Medium Dispersion Solution (C) Including Particulates Including Resin Used for Forming Inner Layer of Shell Layer>

The aqueous medium dispersion solution (C) including the particulates including the resin used for forming the inner layer of the shell layer is prepared by a method suitable according to the type of the resin used for forming the inner layer of the shell layer. Where polyester resin is used as the resin used for forming the inner layer of the shell layer, it is preferable to prepare the particulates including the resin used for forming the inner layer of the shell layer by the same method as the above described method for preparing the particulate including the binder resin. Further, as the resin used for forming the inner layer of the shell layer, carboxyl group containing vinyl-based polymers are preferable, such as (meth)acrylic resin including a unit derived from (meth) acrylic acid, and styrene-(meth)acrylic resin. Hereinafter, a homopolymer and copolymer of a compound including a vinyl group (e.g., ethylene, propylene, (meth)acrylic acid, (meth)acrylic acid ester, and styrene) will be referred to as a vinyl-based polymer.

Description will be made below about the aqueous medium dispersion solution (C) using a carboxyl group containing vinyl-based polymer as the resin used for forming the inner layer of the shell layer.

As the resin used for forming the inner layer of the shell layer, a carboxyl group containing vinyl-based polymer can be used, such as (meth)acrylic resin and styrene-(meth) acrylic resin. For example, the aqueous medium dispersion solution (C) of the particulates including the resin (carboxyl group containing vinyl-based polymer) used for forming the inner layer of the shell layer can be obtained by stirring and mixing an aqueous medium, a crushed article of the carboxyl group containing vinyl-based polymer, a neutralizer, and an organic solvent together in a sealable reaction vessel with a stirrer, a thermometer, and a heater, while heating them.

Where two or more types of carboxyl group containing vinyl-based polymers are used, a mixture of crushed articles of the two or more different types of carboxyl group containing vinyl-based polymers may be used as the above crushed article. Alternatively, a crushed article obtained by crushing a melted and kneaded substance of two or more different types of carboxyl group containing vinyl-based polymers may be used.

Examples of the neutralizer used where a carboxyl group containing vinyl-based polymer is used as the resin used for forming the inner layer of the shell layer include: alkali metal compounds, such as sodium hydroxide and potassium hydroxide; and organic amine compounds, such as ammonium, dimethylamine, trimethylamine, monoethylamine, diethylamine, triethylamine, N,N-dimethylethanolamine, aminoethanolamine, N-methyl-N,N-diethanolamine, isopropylamine, iminobispropylamine, 3-ethoxypropylamine, 3-diethylaminopropylamine, sec-butylamine, propylamine, methylaminopropylamine, 3-methoxypropylamine, monoethanolamine, morpholine, N-methylmorpholine, and N-ethylmorpholine. Among of them, it is preferable to use diethylamine or triethylamine as the neutralizer. Further, only one type of neutralizer may be used. Alternatively, two or more types of neutralizers may be used in combination.

The boiling point of the neutralizer used for preparing the aqueous medium dispersion solution (C) is preferably 0° C. or higher and 250° C. or lower. Too low boiling point may tend to cause volatilization of the neutralizer from the aqueous medium dispersion solution (C). This may lead to impairment of the dispersibility of the particulates including the carboxyl group containing vinyl-based polymer in the aqueous medium. By contrast, too high boiling point of the neutralizer may tend to cause the neutralizer to remain in the toner. This may lead to impairment of the heat resistant preservability of the toner.

The amount of use of the neutralizer used for preparing the aqueous medium dispersion solution (C) is preferably 0.5 mole equivalents or more and 15 mole equivalents or less, more preferably 0.8 mole equivalents or more and 3.0 mole equivalents or less, and particularly preferably 1.0 mole equivalent or more and 2.5 mole equivalents or less relative to the number of moles of the carboxyl group included in the carboxyl group containing vinyl-based polymer.

Where an organic amine compound and/or ammonium is/are used as the neutralizer, at least part of the organic amine compound and/or the ammonium in the aqueous medium dispersion solution (C) can be evaporated by performing solvent removal of the aqueous medium dispersion solution (C) of the particulates including the carboxyl group containing vinyl-based polymer. In the case where such solvent removal is performed, the amount of the organic amine compound and/or the ammonium, which is/are allowed to remain in the aqueous medium dispersion solution (C), is preferably 0.5 mole equivalents or more relative to the number of moles of the carboxyl group included in the carboxyl group containing vinyl-based polymer. The use of the aqueous medium dispersion solution (C) thus prepared can easily enhance the heat resistant preservability of the toner. The content of the organic amine compound and/or ammonium in the toner can be determined by gas chromatography, for example.

In order to enhance the dispersibility of the particulates, an organic solvent may be used in preparation of the aqueous medium dispersion solution (C) of the particulates including the carboxyl group containing vinyl-based polymer. Examples of the organic solvent include: alcohols, such as methanol, ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, and cyclohexanol; ketones, such as methyl ethyl ketone, methyl isobutyl ketone, ethyl butyl ketone, cyclohexanone, and isophorone; ethers, such as tetrahydrofuran and dioxane; esters, such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate, and dimethyl carbonate; glycols (or glycol derivatives), such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monoethyl ether, diethylene glycol monomethyl ether, diethylene glycol monobutyl ether, diethylene glycol ethyl ether acetate, propylene glycol, propylene glycol monomethyl ether, propylene glycol monobutyl ether, and propylene glycol methyl ether acetate; 3-methoxy-3-methylbutanol; 3-methoxybutanol; acetonitrile; dimethylformamide; dimethylacetamide; diacetone alcohol; and ethyl acetoacetate. In view of the fact that removal from the aqueous medium dispersion solution (C) is easy, it is preferable to use one or more types selected from methanol, ethanol, n-propanol, and isopropanol as the organic solvent. Two or more types of the organic solvents may be used in combination.

The solubility of the organic solvent at 20° C. used for preparing the aqueous medium dispersion solution (C) is preferably 50 g/liter or higher, and more preferably 100 g/liter or higher relative to water of 1 liter. The boiling point of the organic solvent is preferably 30° C. or higher and 250° C. or lower, and more preferably 50° C. or higher and 200° C. or lower. The use of an organic solvent having such properties can result in favorable dispersion of the particulates including the carboxyl group containing vinyl-based polymer in the aqueous medium.

The molecular weight of the organic solvent used in preparation of the aqueous medium dispersion solution (C) is preferably 90 or lower. Too high molecular weight may impair the dispersibility of the particulate including the carboxyl group containing vinyl-based polymer in the aqueous medium. It is noted that the molecular weight of the organic solvent used in preparation of the aqueous medium dispersion solution (C) is not particularly limited within the scope not adversely affecting the purpose of the present disclosure.

The amount of use of the organic solvent used in preparation of the aqueous medium dispersion solution (C) is preferably 5% by mass or higher and 50% by mass or lower relative to the mass of the carboxyl group containing vinyl-based polymer.

The volume average particle diameter of the particulates including the resin forming the inner layer of the shell layer is preferably 0.03 μm or larger and 0.50 μm or smaller, and more preferably 0.05 μm or larger and 0.30 μm or smaller. Where the volume average particle diameter of the particulates including the resin forming the inner layer of the shell layer is 0.03 μm or larger and 0.50 μm or smaller, it can be easy to uniformly form the covering layer I formed of the particulates including the resin used for forming the inner layer of the shell layer on the surface of the toner core. The volume average particle diameter of the particulates including the resin used for forming the inner layer of the shell layer can be measured using an electrophoretic light scattering photometer ("LA-950V2" by HORIBA, Ltd.).

It is noted that in order to stabilize the dispassion state of the particulates in the dispersion solution before mixing the aqueous medium dispersion solution (C) with the aqueous medium dispersion solution (B), it is preferable to adjust the pH of the aqueous medium dispersion solution (C) to be about 8 by adding a basic substance to the aqueous medium dispersion solution (C) in advance.

[Step (III)]

In Step (III), the aqueous medium dispersion solution (D) obtained in Step (II) is heated. This can obtain the aqueous medium dispersion solution (E) including the toner cores with the covering layer I on its surface. The covering layer I is formed of the particulates including the resin used for forming the inner layer of the shell layer. The temperature to heat the aqueous medium dispersion solution (D) is preferably 50° C. or higher and 65° C. or lower. Heating the aqueous medium dispersion solution (D) at a temperature of 50° C. or higher and 65° C. or lower can result in uniform formation of the covering layer I on the surface of the toner cores.

[Step (IV)]

In Step (IV), the aqueous medium dispersion solution (F) of the particulates including the resin used for forming the outer layer of the shell layer is mixed with the aqueous medium dispersion solution (E) obtained in Step (III). This can obtain the aqueous medium dispersion solution (G) including the toner cores with the covering layer I on its surface and the particulates including the resin used for forming the outer layer of the shell layer. The method for mixing the aqueous medium dispersion solution (F) with the aqueous medium dispersion solution (E) is not particularly limited within the scope not adversely affecting the purpose of the present disclosure. Further, one example of the method for preparing the aqueous medium dispersion solution (F) of the particulates including the resin used for forming the outer layer of the shell layer may be the same method as the aforementioned suitable method for preparing the aqueous medium dispersion solution (C) of the particulate including the resin used for forming the inner layer of the shell layer.

The volume average particle diameter of the particulates including the resin used for forming the outer layer of the shell layer is preferably 0.03 μm or larger and 0.50 μm or smaller, and more preferably 0.05 μm or larger and 0.30 μm or smaller. Where the volume average particle diameter of the particulates including the resin used for forming the outer layer of the shell layer is 0.03 μm or larger and 0.50 μm or smaller, a covering layer II, which will be described later, can be easily and uniformly formed on the outer surface of the covering layer I. The volume average particle diameter of the particulates including the resin used for forming the outer layer of the shell layer can be measured using an electrophoretic light scattering photometer ("LA-950V2" by HORIBA, Ltd.), for example.

It is noted that in order to stabilize the dispersed sated of the particulates in the dispersion solution, it is preferable to add a basic substance to the aqueous medium dispersion solution (F) so as to adjust the pH of the aqueous medium dispersion solution (F) to be about 8 before mixing the aqueous medium dispersion solution (F) with the aqueous medium dispersion solution (E).

[Step (V)]

In Step (V), the aqueous medium dispersion solution (G) obtained in Step (IV) is heated. This can obtain the aqueous medium dispersion solution (H) including the toner cores with the covering layer I and the covering layer II. The covering layer II covers the outer surface of the covering layer I. The covering layer II is formed of the particulates including the resin used for forming the outer layer of the shell layer. The temperature to heat the aqueous medium dispersion solution (G) is preferably 50° C. or higher and 85° C. or lower. Heating the aqueous medium dispersion solution (G) at a temperature of 50° C. or higher and 85° C. or lower can easily and uniformly form the covering layer II on the outer surface of the covering layer I.

[Step (VI)]

In Step (VI), the aqueous medium dispersion solution (H) obtained in Step (V) is heated. This can form the shell layer on the surface of the toner core. Further, the obtained aqueous medium dispersion solution includes the toner particles or the toner base particles. The shell layer includes the inner layer and the outer layer. It is preferable to add the aforementioned aggregation terminating agent to the aqueous medium dispersion solution (H) when formation of the covering layer II proceeds to a desired extent before heating the aqueous medium dispersion solution (H). Examples of the aggregation terminating agent include sodium chloride and sodium hydroxide.

The temperature to heat the aqueous medium dispersion solution (H) is preferably equal to or higher than the glass transition point (Tg) of the resin used for forming the outer layer of the shell layer and 90° C. or lower. Heating the aqueous medium dispersion solution (G) at a temperature of Tg or higher and 90° C. or lower enables favorable progress of formation of the covering layer I and the covering layer II and in turn favorable covering of the toner core with the shell layer.

[Step (VII)]

The toner particles or the toner base particles obtained in Step (VI) are washed with water in the washing step (VII), as necessary. Examples of the washing method include the following first and second methods. In the first method, solid-liquid separation (e.g., filtration) is performed to collect toner particles or toner base particles as a wet cake from an aqueous medium dispersion solution including the toner particles or the toner base particles. Then, the obtained wet cake is washed with water. In the second method, the particles in an aqueous medium dispersion solution including toner particles or toner base particles are precipitated. Then, the supernatant liquid is substituted with water. Thereafter, the toner particles or the toner base particles are dispersed in water again. It is noted that the washing method is not particularly limited.

[Step (VIII)]

As necessary, the toner particles or the toner base particles obtained in Step (VI) may be dried in Step (VIII). One example of a suitable drying method in Step (VIII) may be a method using a dryer, such as a splay dryer, a fluidized bed dryer, a vacuum freeze dryer, or a vacuum dryer. The method using a spray dryer is more preferable since it can easily prevent aggregation of the toner particles in drying. In order to attach an external additive to the particles (toner base particles) collected in Step (VI), it is preferable to use a spray dryer for spraying a dispersion solution of the external additive (e.g., silica) together with an aqueous medium dispersion solution including the toner base particles to the toner base particles. This can attach the external additive to the surfaces of the toner base particles. It is noted that the method for drying the toner particles or the toner base particles in Step (VIII) is not particularly limited.

[Step (IX)]

As necessary, an external additive may be attached to the surface of the electrostatic charge image developing toner, which is produced by the method according to the present disclosure. At Step (IX), the external additive is attached to the surfaces of the particles (toner base particles) collected through the above steps. One example of a suitable method for attaching the external additive to the surfaces of the toner base particles may be such that the toner base particles are mixed with the external additive by a mixer, such as a Henschel mixer and a Nauta mixer under a condition adjusted so that the external additive is not embedded in the surfaces of the toner base particles. The method for attaching the external additive to the surfaces of the toner base particles is not particularly limited.

The above described electrostatic charge image developing toner according to the present disclosure can be favorably fixed to a recording medium in a wide temperature range. Further, the electrostatic charge image developing toner of the present disclosure is excellent in heat resistant preservability and mechanical strength. The electrostatic charge image developing toner of the present disclosure can be suitably used in various types of image forming apparatuses.

EXAMPLES

The present disclosure will be described further in detail in the following examples. It is noted that the present disclosure is not limited to the examples.

Preparation Example 1

(Preparation of Polyester Resin Particulate Dispersion Solution)

In Preparation Example 1, polyester resin particulate dispersion solutions A-H were prepared using polyester resins having property value listed in Table 1. The polyester resins were prepared with appropriate change in blend ratio of the following monomers a-d.

Monomer a: polyoxypropylene(2,2)-2,2-bis(4-hydroxyphenyl)propane

Monomer b: polyoxyethylene(2,0)-2,2-bis(4-hydroxyphenyl)propane

Monomer c: fumaric acid

Monomer d: trimellitic acid

TABLE 1

| | Polyester resin particulate dispersion solution | | | | | | | |
|---|---|---|---|---|---|---|---|---|
| Property value | A | B | C | D | E | F | G | H |
| Number average molecular weight (Mn) | 2,500 | 2,500 | 2,400 | 2,500 | 2,600 | 2,500 | 3,500 | 3,400 |
| Mass average molecular weight (Mw) | 6,500 | 6,600 | 6,500 | 6,600 | 6,600 | 6,700 | 8,700 | 8,300 |
| Molecular weight distribution (Mw/Mn) | 2.6 | 2.6 | 2.7 | 2.6 | 2.5 | 2.7 | 2.5 | 2.4 |
| Melting point (Tm) [° C.] | 91 | 91 | 91 | 92 | 92 | 92 | 93 | 91 |

TABLE 1-continued

| Property value | Polyester resin particulate dispersion solution | | | | | | | |
|---|---|---|---|---|---|---|---|---|
| | A | B | C | D | E | F | G | H |
| Glass transition point (Tg) [° C.] | 51 | 51 | 51 | 52 | 52 | 52 | 53 | 51 |
| Solubility parameter (SP value) | 11.5 | 11.3 | 11.2 | 10.3 | 10.1 | 10.0 | 10.2 | 10.2 |

Each polyester resin was crushed using a crusher to obtain polyester resin powder with an average particle diameter of about 30 μm. Next, 200 g of the obtained polyester resin powder, 30 g of an aqueous solution of 1N-sodium hydroxide (concentration of 4%), and 770 g of ion exchanged water were mixed together using a mixer to obtain an aqueous suspension including the polyester resin powder.

Subsequently, the obtained aqueous suspension including the polyester resin powder was put into a 2-liter round-bottom stainless container with a capacitor and a stirrer ("RW20 digital" by IKA Works Japan). Then, 1% by mass of an anion-based surfactant ("EMAL 0 (sodium lauryl sulfate)" by Kao Corporation) relative to the mass of the resin was additionally introduced into the stainless container. Thereafter, the temperature of the aqueous suspension was increased to 95° C. The aqueous suspension was stirred at a temperature of 95° C. and at a rotation speed of 200 rpm for 30 minutes. Then, the aqueous suspension, which was quickly cooled to normal temperature, was filtered with a 300-mesh filter to obtain a wet cake of a low oligomer polyester resin. Next, the wet cake of the low oligomer polyester resin was washed with water and was then dried. Thus, low oligomer polyester resin powder was obtained.

The obtained low oligomer polyester resin powder was put into a heating kneader with a jacket for temperature adjustment ("TK HIVIS DISPER MIX HM-3D-5" by PRIMIX Corporation). The low oligomer polyester resin powder was stirred at an orbital speed of 20 rpm and a rotation speed of 48 rpm, while being heated up to 120° C., thereby melting the low oligomer polyester resin powder. Thereafter, 80 g of triethanolamine (basic compound) and 80 g of an aqueous solution of sodium lauryl sulfate ("EMAL 0" by Kao Corporation) at a concentration of 25% by mass were added to the melt. Next, the melt was stirred at an orbital speed of 40 rpm and a rotation speed of 97 rpm for 15 minutes. Subsequently, 2870 g of ion exchanged water at a temperature of 98° C. was added to the melt at a speed of 50 g/min. Thus, a resin emulsion was obtained.

Subsequently, the emulsion was cooled to 50° C. at a speed of 5° C./min. Thus, polyester resin particulate dispersion solutions A-H with a solid concentration of 25% by mass were obtained. Each average particle diameter of the polyester resin particulates in the dispersion solutions was about 115 nm. The particle diameter of the polyester resin particulates was measured using a particle size distribution analyzer ("LA-950" by HORIBA, Ltd.).

Preparation Example 2

(Preparation of Acrylic Resin Particulate Dispersion Solution)

In Preparation Example 2, acrylic resin particulate dispersion solutions A-I were prepared using acrylic resins with respective property values listed in Table 2 with the amount of use of a polymerization initiator, a blend ratio of the monomers, and the amount of use of a chain transfer agent appropriately changed.

550 ml of ion exchanged water and 0.35 g of sodium dodecyl sulfate (surfactant) were put into a 1000-ml four-necked flask with a stirrer, a cooling pipe, a nitrogen introduction pipe, and a temperature sensor. Then, the content in the flask was stirred under nitrogen air flow, while its temperature is increased to 80° C. Thereafter, an aqueous solution of potassium peroxodisulfate (concentration of 2.5% by mass) was is additionally put into the flask as a polymerization initiator. Then, a monomer mixed solution containing styrene, n-butyl acrylate, methacrylic acid, and n-octyl mercaptan as a chain transfer agent was dripped into the flask with the use of a dripping funnel, taking 1.5 hours. After the dripping, the reaction solution was stirred at a temperature of 80° C. for 2 hours, thereby completing a polymerization reaction. After completion of the polymerization reaction, the content in the flask was cooled to the room temperature. Then, ion exchanged water was added to the reaction solution so that the solid concentration was 25% by mass. Thus, acrylic resin particulate dispersion solutions A-I were obtained. The average particle diameter of the acryl resin particulates in each dispersion solution was about 90 nm. The average particle diameter of the acrylic resin particulates was measured by the same method as the method for measuring the particle diameter of the polyester resin particulates.

TABLE 2

| Property value | Acrylic resin particulate dispassion solution | | | | | | | | |
|---|---|---|---|---|---|---|---|---|---|
| | A | B | C | D | E | F | G | H | I |
| Number average molecular weight (Mn) | 5,000 | 4,900 | 4,900 | 4,800 | 4,900 | 5,000 | 4,900 | 5,900 | 6,500 |
| Mass average molecular weight (Mw) | 15,000 | 14,800 | 14,700 | 14,900 | 14,900 | 14,900 | 14,800 | 15,800 | 16,300 |
| Molecular weight distribution (Mw/Mn) | 3.0 | 3.0 | 3.0 | 3.1 | 3.0 | 3.0 | 3.0 | 2.7 | 2.5 |
| Melting point (Tm) [° C.] | 120 | 119 | 119 | 120 | 120 | 120 | 119 | 120 | 121 |
| Glass transition point (Tg) [° C.] | 63 | 63 | 63 | 63 | 63 | 63 | 63 | 64 | 65 |
| Solubility parameter (SP value) | 9.7 | 9.6 | 9.5 | 8.7 | 8.6 | 8.5 | 8.4 | 8.3 | 8.5 |

Preparation Example 3

(Preparation of Releasing Agent Particulate Dispersion Solution)

200 g of a releasing agent ("WEP-3 (ester wax)" by NOF CORPORATION), 20 g of an anion-based surfactant ("EMAL 0 (sodium lauryl sulfate)" by Kao Corporation) and 780 g of ion exchanged water were mixed together. Then, the mixture was heated to 90° C. and was then emulsified using a homogenizer (ULTRA-TURRAX T50 (by IKA Works Japan)) at a stiffing speed of 2000 rpm for 5 minutes. Further, emulsification treatment was performed using a high-pressure type homogenizer ("NV-200" by YOSHIDA KIKAI CO., LTD.), to which a heating system is added, under treatment conditions of a temperature of 100° C. and a discharge pressure of 100 MPa. Thus, a releasing agent particulate dispersion solution with a solid concentration of 10% by mass was obtained. The average particle diameter of the particulates of the releasing agent included in the releasing agent particulate dispersion solution was 120 nm. The particle diameter of the releasing agent particulates was measured by the same method as the method for measuring the particle diameter of the polyester resin particulates.

Preparation Example 4

(Preparation of Pigment Particulate Dispersion Solution)

100 g of a cyan pigment (C.I. pigment blue 15:3 (copper phthalocyanine)), 20 g of sodium polyoxyethylene lauryl sulfate ("EMAL E27C" by Kao Corporation), and 380 g of ion exchanged water were mixed together. Then, the mixture and 400 ml of beads (made of zirconium) with a diameter of 0.1 mm were put into a stirring vessel of ULTRA APEX MILL (by KOTOBUKI INDUSTRIES CO., LTD.). Then, dispersion treatment was performed at a peripheral speed of a rotor of 10 m/sec for 2 hours. Thus, a pigment particulate dispersion solution was obtained in which the concentration of the pigment was 20% by mass, and the total solid concentration was 21% by mass. The average particle diameter of the pigment particulates included in the pigment particulate dispersion solution was 113 nm. The particle diameter of the pigment particulates was measured by the same method as the method for measuring the particle diameter of the polyester resin particulates.

Examples 1-4 and Comparative Examples 1-8

[Preparation of Toner Base Particles]

340 g of the polyester resin (binder resin) particulate dispersion solutions of the types listed in Tables 3-5, 100 g of the releasing agent particulate dispersion solution, 25 g of the pigment particulate dispersion solution, and 500 g of ion exchanged water were put into a 2-liter round-bottom stainless flask. Then, the contents in the flask were mixed at a temperature of 25° C. Next, the mixture in the flask was stirred using a stirring impeller at a rotation speed of 200 rpm for 10 minutes. Subsequently, the pH of the mixture in the flask was adjusted to be 10 with the use of an aqueous solution of sodium hydroxide. Thereafter, the mixture was stirred for 10 minutes.

Subsequently, 10 g of an aqueous solution of magnesium chloride hexahydrate (coagulant) at a concentration of 50% by mass was dripped into the flask, taking 5 minutes. Next, the mixture in the flask was increased in temperature at a speed of 0.2° C./min. to allow the particulates to start aggregating. Then, the temperature increase was ceased at a temperature of 50° C.

Thereafter, the mixture in the flask was maintained at a temperature of 50° C. for 30 minutes, while being stirred at 300 rpm, thereby allowing aggregation of particulates to proceed. Then, 50 g of an aqueous solution of sodium chloride at a concentration of 20% by mass was added to the mixture in the flask to stop progress of the aggregation of particulates. Thus, a aggregated particulate dispersion solution including the aggregated particulates was obtained.

100 g of an aqueous solution of sodium lauryl sulfate ("EMAL 0" by Kao Corporation) at a concentration of 5% by mass was added to the aggregated particulate dispersion solution in the flask. Next, the dispersion solution including the aggregated particulates was increased in temperature up to 65° C. at a speed of 0.2° C./min., while being stirred at a stirring speed of 300 rpm. Then, stiffing at 65° C. and at 300 rpm was performed for 1 hour to coalesce the toner components included in the aggregated particulates and to control the shape of the aggregated particulates to have a spherical form. Next, the dispersion solution including the aggregated particulates was cooled to 25° C. at a speed of 10° C./min. Thus, a toner core dispersion solution was obtained which includes the shape-controlled aggregated particulates as the toner core.

Subsequently, 100 g of each polyester resin particulate dispersion solution listed in Tables 3-5 (material for the inner layer of the shell layer) was added to the toner core dispersion solution in the flask. Prior to this addition, the pH of the polyester resin particulate dispersion solution was adjusted to be 8 with the use of an aqueous solution of sodium hydroxide.

Then, the content in the flask was increased in temperature up to 55° C. at a speed of 0.2° C./min., while being stirred at a stirring speed of 300 rpm. Thereafter, stirring was performed at 55° C. and at 300 rpm for 1 hour. Thus, a dispersion solution of the toner core covered with the polyester resin particulates was obtained.

In addition, 202 g of each acrylic resin particulate dispersion solution listed in Tables 3-5 (material for the outer layer of the shell layer) was added to the dispersion solution in the flask. Prior to this addition, the pH of the acrylic resin particulate dispersion solution was adjusted to be 8 with the use of an aqueous solution of sodium hydroxide.

The content in the flask was increased in temperature up to 60° C. at a speed of 0.2° C./min., while being stirred at a stirring speed of 300 rpm. Thereafter, stirring at 60° C. and at 300 rpm was performed for 2 hours. Thus, the surface of the covering layer (layer formed of the polyester resin particulates) on the toner core was covered with the acrylic resin particulates.

Next, an aqueous solution of sodium chloride (aqueous solution in which 71.5 g of sodium chloride was dissolved in 288 g of ion exchanged water) was added to the content in the flask. Then, the content in the flask was increased in temperature up to 95° C. at a speed of 0.5° C./min., while being stirred at a stirring speed of 360 rpm. Next, the content in the flask was stirred at 95° C. and at 360 rpm for 2 hours. Then, the content in the flasks was cooled to 25° C. at a speed of 1° C./min. Subsequently, the pH of the content in the flask was adjusted to be 2 with the use of hydrochloric acid. Thus, a toner base particle dispersion solution including the toner base particles was obtained. The toner base particles each have the toner core and the shell layer formed on the surface of the toner core.

The volume average particle diameter and the sphericity of the toner base particles obtained as above were measured using a particle size distribution analyzer "Microtrac UPA150" by NIKKISO CO., LTD.). The volume average particle diameter and the spheroidicity of the toner base particles obtained in Examples 1-4 and Comparative Examples 1-8 were 5.5 μm and about 0.98, respectively.

[Washing Step]

A wet cake of the toner base particles was collected by filtration from each toner base particle dispersion solution with the use of a Büchner funnel. The wet cake of the toner base particles was dispersed again in ion exchanged water to wash the toner base particles. Further, the similar washing using ion exchanged water was repeated for the toner base particles six times.

[Drying Step]

The wet cake of the toner base particles was dispersed in an aqueous ethanol solution at a concentration of 50% by mass to prepare slurry. The obtained slurry was supplied to a continuous type surface modifier ("COATMIZER" by Freund Corporation) to dry the toner base particles in the slurry. Thus, the toner base particles were obtained. Drying by hot wind at a temperature of 45° C. and a flow rate of 2 $m^3$/min was performed using COATMIZER.

[Externally Adding Step]

External addition was performed on the toner base particles obtained in Examples and Comparative Examples. Specifically, 100 parts by mass of the toner base particles and 0.4 parts by mass of positively chargeable silica ("Silica 90G" by Nippon Aerosil Co., Ltd.: silica of which surface is subjected to treatment with silicone oil and aminosilane) were mixed together at a stirring speed of 30 m/sec. for 5 minutes with the use of a 5-liter Henschel mixer (by MITSUI MIIKE MACHINERY Co., Ltd.). Thus, the external additive was attached to the surfaces of the toner base particles. Then, the toner was sieved using a 300-mesh sieve (aperture of 48 μm).

<<Evaluation>>

Evaluation of the fixability, heat resistance, and strength was performed on each toner obtained through Examples 1-4 and Comparative Examples 1-8. Tables 3-5 indicate results of the evaluation of the fixability, heat resistance, and strength on each toner obtained through Examples 1-4 and Comparative Examples 1-8.

A two-component developer used for the fixability evaluation was prepared by the following method.

[Preparation of Two-Component Developer]

(Preparation of Carrier)

Materials were blended so as to be 39.7 mol % in terms of MnO, 9.9 mol % in terms of MgO, 49.6 mol % in terms of $Fe_2O_3$, and 0.8 mol % in terms of SrO. Water was added to these materials, and the mixture was crushed and mixed taking 10 hours by a wet type ball mill. The obtained mixture was dried and was then maintained at 950° C. for 4 hours. Then, the mixture was crushed taking 24 hours by a wet type ball mill to prepare slurry. Next, the slurry was granulated and dried. Thereafter, the granulated substance was left in an atmosphere of 2% oxygen concentration at 1270° C. for 6 hours. Then, the granulated substance was cracked to adjust the particle size of the cracked substance. Thus, manganese-based ferrite particles (carrier core) were obtained. The average particle diameter of the obtained manganese-based ferrite particles was 35 μm. Its saturation magnetization when a magnetic field of 3000 ($10^3/4\pi \cdot A/m$) was applied was 70 $Am^2$/kg.

Subsequently, polyamide-imide resin (copolymer of trimellitic anhydride and 4,4'-diaminodiphenylmethane) was diluted with methyl ethyl ketone to prepare a resin solution. Next, a tetrafluoroethylene-hexafluoropropylene copolymer (FEP) and silicon oxide (2% by mass relative to the total amount of the resin) were dispersed in the resin solution to obtain a carrier coating liquid in the amount of 150 g in terms of solid content. The mass ratio (polyamide-imide resin/FEP) between the polyamide-imide resin and the FEP was 2/8. The rate of the solid content of the resin solution was 10% by mass.

The manganese-based ferrite particles of 10 kg was coated with the resin with the use of the obtained carrier coating liquid and a fluidized bed coater ("SPIRA COTA SP-25" by OKADA SEIKO CO., LTD.). Then, manganese-based ferrite particles covered with the resin were baked at a temperature of 220° C. for 1 hour. Thus, resin coated ferrite carrier of a resin coating amount of 3% by mass was obtained.

(Mixing of Toner and Carrier)

The toner obtained in each of Examples and Comparative Examples and the carrier were mixed together using a Nauta mixer for 30 minutes under conditions of normal temperature and normal humidity and a rotation speed of 78 rpm so that the mass of the toner relative to the mass of a resultant two-component developer was 8.0% by mass. Thus, a two-component developer was obtained.

<Fixability Evaluation>

A multifunctional peripheral (TASKalfa 5550ci (by KYOCERA Document Solutions Inc.)) modified so that the fixing temperature is adjustable was used as an evaluation apparatus. The evaluation apparatus includes an aluminum fixing roller coated with PFA resin with a film thickness of 30 μm±10 μm and a surface roughness (Ra) of 5 μm. The linear velocity of paper conveyance of the evaluation apparatus was set at 266 mm/sec. Then, non-fixed solid images (toner placement amount of 1.5 mg/$cm^2$) were formed on recording media with the use of the obtained two-component developers and toners. In the fixing temperature range of 80° C. or higher and 200° C. or lower, the fixing temperature of the fixing device of the multifunctional peripheral was increased 10° C. by 10° C. from 80° C. to fix the solid images. Using each obtained fixed image, the lower and upper limits of the fixing temperature were measured by the following measuring method. The fixability was evaluated with reference to the following references.

OK: the lower limit of the fixing temperature was 100° C. or lower, and the upper limit of the fixing temperature was 200° C. or higher.

NG: the lower limit of the fixing temperature was over 100° C., or the upper limit of the fixing temperature was below 200° C.

(Method for Measuring Lower and Upper Limit of Fixing Temperature)

The image density of each fixed solid image before and after a fastness test, which was formed with the fixing temperature changed 10° C. by 10° C., was measured. Further, by the following equation, the density rate was calculated from the image density before and after the fastness test.

$$\text{Density rate (\%)} = (\text{image density after friction}/\text{image density before friction}) \times 100$$

The temperature at which a solid image with a density rate of 80% or higher could be fixed was defined as fixable temperature. The lower limit value of the fixable temperature was defined as the lower limit of the fixing temperature. By contrast, the upper limit value of the fixable temperature was defined as the upper limit of the fixing temperature. It is noted that the fastness test was performed under conditions of a 200 g load and a 20-stroke friction using a Gakushin (Japan Society for the Promotion of Science (JSPS)) type rubbing fastness tester (JIS L 0849 II type by YASUDA SEIKI SEISAKUSHO, LTD.). Further, each image density was measured using a reflection densitometer ("RD-918" by GretagMacbeth).

<Method for Evaluation of Heat Resistant Preservability>

Each toner of 3 g was put into a 20-ml plastic container and was subjected to tapping treatment for 5 minutes. Thereafter, the container was left in a temperature-constant bath set at 55° C. for 8 hours. Thus, first toners for evaluation of the heat resistant preservability (55° C., 8 hours) were obtained. Each first toner for evaluation of the heat resistant preservability was put on a 300-mesh sieve (aperture of 48 μm). Then, in accordance with a manual for a powder tester (by Hosokawa Micron Corporation), sieving with the level of a rheostat set at 5 was performed for 30 seconds. After the sieving, the mass of the toner remaining on the sieve was measured. Then, the aggregation degree [%] was obtained by the following equation.

(Equation for Computation of Aggregation Degree)

Aggregation degree [%]=(mass of toner remaining on sieve after sieving/mass of toner before sieving)×100

Further, second toners for evaluation of the heat resistant preservability (60° C., 8 hours) were prepared by the same method as the method for preparing the first toners for evaluation of the heat resistant preservability, except that the temperature in the temperature-constant bath was changed from 55° C. to 60° C. Then, the aggregation degree [%] of each second toner for evaluation of the heat resistant preservability was obtained by the above equation.

The heat resistant preservability was evaluated with reference to the following references. Reference marks OK and NOR. were determined as OK, while NG was determined as failure.

OK: aggregation degree of the toner was below 20%.

NOR: aggregation degree of the toner was equal to or higher than 20% and below 50%.

NG: aggregation degree of the toner was equal to or higher than 50%.

<Method for Strength Evaluation>

0.1 g of each toner, 20 g of zirconium beads with an average particle diameter of 1 mm, and 40 ml of ion exchanged water were put into a 50-ml glass bottle. A toner strength test was performed using a stirring mixer ("TURBULA T2F type" by Willy A. Bachofen AG). Specifically, the content in the glass bottle was stirred and mixed at a stirring speed of 90 rpm for 5 minutes. After the strength test on the toner, the zirconium beads were separated from the mixture. Thus, an aqueous medium dispersion solution including the toner particles was obtained. The particle diameter and the luminance value of the toner particles included in the obtained aqueous medium dispersion solution were measured. For measurement of the particle diameter and the luminance value, FPIA-3000 (by SYSMEX CORPORATION) was used. Thus, there were obtained the number (X) of the toner particles with a particle diameter of 3 μm or larger, the number (Y) of the toner particles with a particle diameter of 3 μm or larger and a luminance value of 100 or higher among the toner particles in each sample. The value of Y corresponds to the number of toner particles collapsed by the strength test. The collapse rate [%] was obtained by the following equation.

Collapse rate [%]=$(Y/X)\times 100$

The strength was evaluated with reference to the following references.

Ok: collapse rate was below 1.0%.

NG: collapse rate was equal to or higher than 1.0%.

TABLE 3

| | | Examples | | | |
|---|---|---|---|---|---|
| | | 1 | 2 | 3 | 4 |
| Toner core-Binder resin (polyester resin particulate dispersion solution) | | | | | |
| | Type | A | D | A | A |
| | $SP_c$ | 11.5 | 10.3 | 11.5 | 11.5 |
| Shell layer-Inner layer (polyester resin particulate dispersion solution) | | | | | |
| | Type | C | F | E | E |
| | $SP_t$ | 11.2 | 10.0 | 10.1 | 10.1 |
| Shell layer-Outer layer (acrylic resin particulate dispersion solution) | | | | | |
| | Type | B | C | F | E |
| | $SP_s$ | 9.6 | 9.5 | 8.5 | 8.6 |
| | $\Delta SP_1$ $(SP_c - SP_t)$ | 0.3 | 0.3 | 1.4 | 1.4 |
| | $\Delta SP_2$ $(SP_t - SP_s)$ | 1.6 | 0.5 | 1.6 | 1.5 |
| Evaluation result | | | | | |
| Fixability | Lower limit of fixing temperature [° C.] | 100 | 100 | 100 | 100 |
| | Upper limit of fixing temperature [° C.] | 200 | 200 | 200 | 200 |
| | Evaluation | OK | OK | OK | OK |
| Heat resistant preservability | 55° C., 8 hours Aggregation degree [%] | 11 | 10 | 12 | 11 |
| | Evaluation | OK | OK | OK | OK |
| | 60° C., 8 hours Aggregation degree [%] | 18 | 17 | 18 | 17 |
| | Evaluation | OK | OK | OK | OK |
| Strength | Collapse rate [%] | 0.7 | 0.4 | 0.6 | 0.5 |
| | Evaluation | OK | OK | OK | OK |

TABLE 4

| | | Comparative Examples | | | |
|---|---|---|---|---|---|
| | | 1 | 2 | 3 | 4 |
| Toner core-Binder resin (polyester resin particulate dispersion solution) | | | | | |
| | Type | A | A | A | D |
| | $SP_c$ | 11.5 | 11.5 | 11.5 | 10.3 |
| Shell layer-Inner layer (polyester resin particulate dispersion solution) | | | | | |
| | Type | E | B | C | F |
| | $SP_t$ | 10.1 | 11.3 | 11.2 | 10.0 |
| Shell layer-Outer layer (acrylic resin particulate dispersion solution) | | | | | |
| | Type | B | A | C | B |
| | $SP_s$ | 9.6 | 9.7 | 9.5 | 9.6 |
| | $\Delta SP_1$ $(SP_c - SP_t)$ | 1.4 | 0.2 | 0.3 | 0.3 |
| | $\Delta SP_2$ $(SP_t - SP_s)$ | 0.5 | 1.6 | 1.7 | 0.4 |
| Evaluation result | | | | | |
| Fixability | Lower limit of fixing temperature [° C.] | 130 | 100 | 100 | 130 |
| | Upper limit of fixing temperature [° C.] | 200 | 180 | 180 | 200 |
| | Evaluation | NG | NG | NG | NG |
| Heat resistant preservability | 55° C., 8 hours Aggregation degree [%] | 10 | 32 | 35 | 16 |

TABLE 4-continued

| | | Comparative Examples | | | |
|---|---|---|---|---|---|
| | | 1 | 2 | 3 | 4 |
| | Evaluation | OK | NOR. | NOR. | OK |
| | 60° C., 8 hours Aggregation degree [%] | 16 | 68 | 70 | 17 |
| | Evaluation | OK | NG | NG | OK |
| Strength | Collapse rate [%] | 0.2 | 1.6 | 1.3 | 0.8 |
| | Evaluation | OK | NG | NG | OK |

TABLE 5

| | | Comparative Examples | | | |
|---|---|---|---|---|---|
| | | 5 | 6 | 7 | 8 |
| Toner core-Binder resin (polyester resin particulate dispersion solution) | | | | | |
| | Type | A | A | A | A |
| | $SP_c$ | 11.5 | 11.5 | 11.5 | 11.5 |
| Shell layer-Inner layer (polyester resin particulate dispersion solution) | | | | | |
| | Type | E | E | E | F |
| | $SP_t$ | 10.1 | 10.1 | 10.1 | 10 |
| Shell layer-Outer layer (acrylic resin particulate dispersion solution) | | | | | |
| | Type | D | G | A | G |
| | $SP_s$ | 8.7 | 8.4 | 9.7 | 8.4 |
| | $\Delta SP_1$ ($SP_c - SP_t$) | 1.4 | 1.4 | 1.4 | 1.5 |
| | $\Delta SP_2$ ($SP_t - SP_s$) | 1.4 | 1.7 | 0.4 | 1.6 |
| Evaluation result | | | | | |
| Fixability | Lower limit of fixing temperature [° C.] | 110 | 120 | 140 | 130 |
| | Upper limit of fixing temperature [° C.] | 190 | 170 | 200 | 200 |
| | Evaluation | NG | NG | NG | NG |
| Heat resistant preservability | 55° C., 8 hours Aggregation degree [%] | 17 | 60 | 11 | 13 |
| | Evaluation | OK | NG | OK | Ok |
| | 60° C., 8 hours Aggregation degree [%] | 32 | 82 | 17 | 18 |
| | Evaluation | NOR. | NG | Ok | OK |
| Strength | Collapse rate [%] | 1.4 | 1.8 | 0.4 | 1.3 |
| | Evaluation | NG | NG | OK | NG |

Each toner in Examples 1-4 (see Table 3) had $\Delta SP_1$ of 0.3 or larger and 1.4 or smaller, $\Delta SP_2$ of 0.5 or larger and 1.6 or smaller, and $\Delta SP_1$ of below $\Delta SP_2$. Such the toner could exhibit favorable fixability to a recording medium in a wide temperature range. Further, such the toner had excellent heat resistant preservability and mechanical strength.

Each toner in Comparative Examples 1 and 7 (see Tables 4 and 5) had $\Delta SP'$ larger than $\Delta SP_2$. Such the toners were hard to be favorably fixed to a recording medium in a low temperature range.

The toner in Comparative Example 5 (see Table 5) had $\Delta SP_1$ and $\Delta SP_2$ equal to each other. The temperature range in which such the toner was fixable was narrow. Further, such the toner had low mechanical strength.

The toner in Comparative Example 2 (see Table 4) had $\Delta SP_1$ of below 0.3. Such the toner was hard to be favorably fixed to a recording medium in a high temperature range. Further, such the toner had low heat resistant preservability and mechanical strength.

Each toner in Comparative Examples 3 and 6 (see Tables 4 and 5) had $\Delta SP_2$ larger than 1.6. The temperature range in which such the toner was fixable was narrow. Further, such the toners had low heat resistant preservability and mechanical strength.

Each toner in Comparative Examples 4 and 7 (see Tables 4 and 5) had $\Delta SP_2$ of below 0.5. Such the toners were hard to be favorably fixed to a recording medium in a low temperature range.

The toner in Comparative Example 8 (see Table 5) had $\Delta SP_1$ larger than 1.4. Such the toner was hard to be favorably fixed to a recording medium in a low temperature range. Further, such the toner had low mechanical strength.

What is claimed is:

1. An electrostatic charge image developing toner, comprising:

a toner core including at least a binder resin; and a shell layer configured to cover the toner core, wherein the shell layer includes an inner layer containing a first resin and an outer layer containing a second resin, $\Delta SP_1$ as a difference obtained by subtracting a SP value of the first resin of the inner layer from a SP value of the binder resin is +0.3 or larger and +1.4 or smaller, $\Delta SP_2$ as a difference obtained by subtracting a SP value of the second resin of the outer layer from the SP value of the first resin of the inner layer is +0.5 or larger and +1.6 or smaller, the $\Delta SP_1$ is below the $\Delta SP_2$, and the binder resin incudes polyester resin.

2. An electrostatic charge image developing toner according to claim 1, wherein the outer layer includes as the second resin, one or more types of resin selected from the group consisting of (meth)acrylic resin and styrene-(meth)acrylic resin.

3. An electrostatic charge image developing toner according to claim 1, wherein the binder resin has a SP value of 11.0 or larger and 12.0 or smaller.

4. An electrostatic charge image developing toner according to claim 1, wherein the first resin of the inner layer has a SP value of 9.5 or larger and 11.5 or smaller.

5. An electrostatic charge image developing toner according to claim 1, wherein the second resin of the outer layer has a SP value of 8.0 or larger and 10.0 or smaller.

6. An electrostatic charge image developing toner according to claim 1, wherein the binder resin contains an oligomer with a molecular weight of 1000 or lower in an amount of 1000 mass ppm or lower relative to a mass of the toner or does not contain an oligomer with a molecular weight of 1000 or lower.

7. An electrostatic charge image developing toner comprising:

a toner core including at least a binder resin; and a shell layer configured to cover the toner core, wherein the shell layer includes an inner layer containing a first resin and an outer layer containing a second resin, $\Delta SP_1$ as a difference obtained by subtracting a SP value of the first resin of the inner layer from a SP value of the binder resin is +0.3 or larger and +1.4 or smaller, $\Delta SP_2$ as a difference obtained by subtracting a SP value of the second resin of the outer layer from the SP value of the first resin of the inner layer is +0.5 or larger and +1.6 or smaller, the $\Delta SP_1$ is below the $\Delta SP_2$ and the inner layer includes polyester resin as the first resin.

* * * * *